US005792080A

United States Patent [19]

Ookawa et al.

[11] Patent Number: 5,792,080

[45] Date of Patent: Aug. 11, 1998

[54] MASSAGING APPARATUS HAVING SELF-ADJUSTING CONSTANT STRENGTH AND NON-ADJUST STRENGTH MODES

[75] Inventors: Kazumi Ookawa; Masatoshi Dairin; Haruo Sugai; Hikoyoshi Hara, all of Hikone, Japan

[73] Assignee: Matsushita Electric Works, Ltd., Osaka, Japan

[21] Appl. No.: 744,507

[22] Filed: Nov. 7, 1996

Related U.S. Application Data

[63] Continuation of Ser. No. 245,632, May 18, 1994, abandoned.

[51] Int. Cl.[6] ..... A61H 15/00

[52] U.S. Cl. ..... 601/115; 601/126; 601/90; 601/99; 601/102; 601/134

[58] Field of Search ..... 601/49, 84, 90, 601/97–103, 107–111, 115–117, 134, 148, 149

[56] References Cited

U.S. PATENT DOCUMENTS

| | | | |
|---|---|---|---|
| 3,951,494 | 4/1976 | Romine . | |
| 4,422,448 | 12/1983 | Sugai et al. . | |
| 4,422,449 | 12/1983 | Hamabe . | |
| 4,850,902 | 7/1989 | Reed . | |
| 4,875,470 | 10/1989 | Cotone | 601/117 |
| 5,083,552 | 1/1992 | Lipowitz | 601/84 |
| 5,265,590 | 11/1993 | Takagi . | |
| 5,456,656 | 10/1995 | Skovira | 601/84 |

FOREIGN PATENT DOCUMENTS

| | | | |
|---|---|---|---|
| 0 475 067 | 3/1992 | European Pat. Off. . | |
| 39 33 658 | 10/1989 | Germany . | |
| 32 43 437 | 7/1990 | Germany . | |
| 4131632 | 4/1992 | Germany | 601/116 |
| 5031147 | 2/1993 | Japan | 601/116 |
| 5168666 | 7/1993 | Japan | 601/84 |
| 6000207 | 1/1994 | Japan | 601/84 |
| 6190012 | 7/1994 | Japan | 601/84 |
| 9414399 | 7/1994 | WIPO | 601/115 |

*Primary Examiner*—Danton D. DeMille

*Attorney, Agent, or Firm*—Armstrong, Westerman, Hattori, McLeland & Naughton

[57] ABSTRACT

A massaging apparatus has a capability of self-adjusting a massage strength for giving an optimum massaging effect for individual users. The apparatus includes a supporting frame on which a user rest and an applicator projecting from the supporting frame to be pressed against a user's body. The applicator is driven to move for applying a massaging force to the user's body. A pressure sensor is provided to monitor a pressure applied back to the applicator from the user's body as a counter-action of applying the massaging force to the user's body and to provide an output indicative of the monitored pressure. A strength-adjustor is included to vary a projecting amount of the applicator from the supporting frame and/or an operational speed of moving the applicator in order to adjust a massage strength applied to the user's body. The massaging apparatus is characterized to include an auto-controller which is connected to receive the output from the pressure sensor and actuates the strength-adjustor in order to increase and decrease the massage strength in such a manner as to follow the monitored pressure. Whereby, the apparatus is enabled to self-adjust the massage strength in proportion to a force at which the user has its back or desired portion pressed against the applicator.

19 Claims, 26 Drawing Sheets

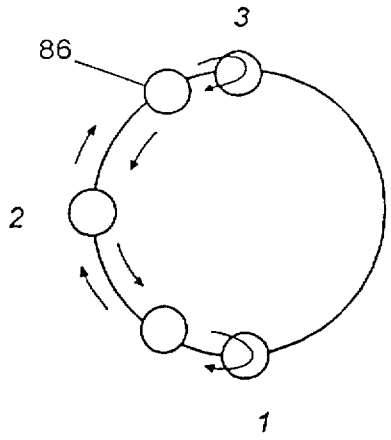
FIG. 33A
FIG. 33B
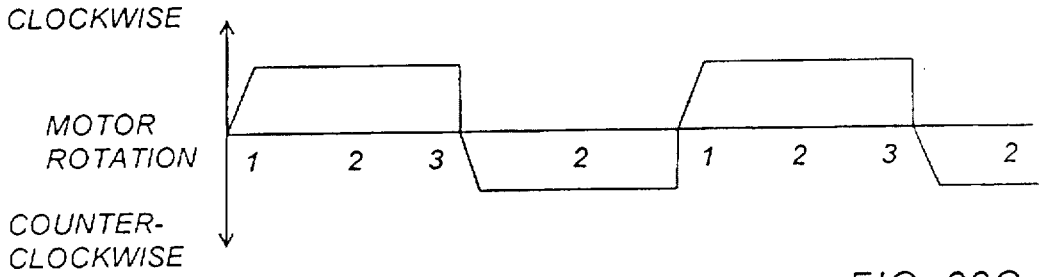
FIG. 33C
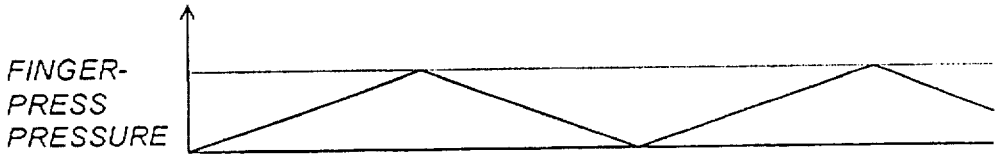
FIG. 34A
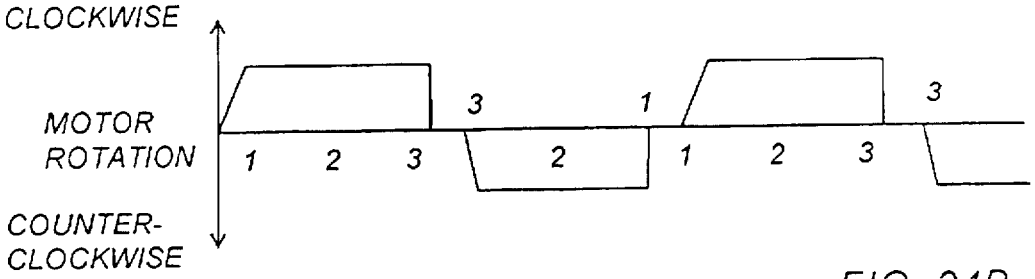
FIG. 34B
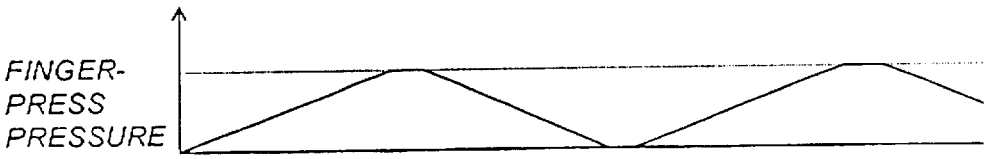

MASSAGING APPARATUS HAVING SELF-ADJUSTING CONSTANT STRENGTH AND NON-ADJUST STRENGTH MODES

This application is a continuation of application Ser. No. 08/245,632 filed May 18, 1994, now abandoned.

BACKGROUND OF THE INVENTION

1. Field of the Invention

The present invention is directed to a massaging apparatus, and more particularly to a massaging apparatus with a capability of adjusting a massage strength applied by an applicator to an user's body.

2. Description of the Prior Art

There have been proposed in the prior art a massaging apparatus with a capability of adjusting a massage strength, for example, as disclosed in U.S. Pat. Nos. 4,422,448, 4,422,449, and 5,265,590. The massaging apparatus comprises an applicator projecting from a supporting frame on which a user rest. The applicator is pressed against the user's body and is driven to move for applying a massaging force to the user's body. The prior art massaging apparatus includes a manual controller for adjusting the massage strength by varying the projecting amount of the applicator and/or an operational speed of moving the applicator. Although the massaging apparatus enables the user to adjust the massage strength as desired, re-adjustment of the strength must be necessary each time different persons use the apparatus for enjoying their own optimum massage strength. In this sense, the prior apparatus is not sufficiently convenient for use by different persons.

SUMMARY OF THE INVENTION

The above insufficiency has been eliminated in a massaging apparatus of the present invention. The apparatus includes a supporting frame on which a user rest and an applicator projecting from the supporting frame to be pressed against a user's body. The applicator is driven to move for applying a massaging force to the user's body. A pressure sensor is provided to monitor a pressure applied back to the applicator from the user's body as a counter-action of exerting the massaging force to the user's body and to provide an output indicative of the monitored pressure. A strength-adjustor is included to vary a projecting amount of the applicator from the supporting frame and/or an operational speed of moving the applicator in order to adjust a massage strength applied to the user's body. The massaging apparatus is characterized to include an auto-controller which is connected to receive the output from the pressure sensor and actuates the strength-adjustor in order to increase and decrease the massage strength in such a manner as to follow the monitored pressure. Whereby, the apparatus is enabled to self-adjust the massage strength in proportion to a force at which the user has its back or desired portion pressed against the applicator.

Accordingly, it is a primary object of the present invention to provide a massaging apparatus which is capable of self-adjusting the massage strength in accordance with the user's preference simply by pressing the user's body against the applicator even during the massaging.

In order to make the control more consistent and comfortable, the auto-controller includes a nullifier circuit which invalidates an instantaneous variation in the monitored pressure within a predetermined short-time period so that the auto-controller will not respond to adjust the massage strength.

It is therefore another object of the present invention to provide a massaging apparatus which is capable of smoothly adjusting the massage strength free from over-reaction that would otherwise irritate the user.

The massaging apparatus is preferred to include a manual-controller for manually adjusting the massage strength independently of the auto-controller. In order to make compatible with the manual controller, the auto-controller is configured to include a delay circuit which enables the auto-controller to adjust the massage strength only after a predetermined delay from the time of manually adjusting the massage strength by the manual controller.

It is therefore a further object of the present invention to provide a massaging apparatus which enables the manual and auto-control of adjusting the massage strength in combination.

The massaging apparatus also includes a pressure controller which, in response to the monitored pressure from the pressure sensor, actuates the strength-adjustor to increase and decrease the massage strength in order to balance the monitored pressure with a predetermined pressure level. Whereby, the pressure controller acts to keep the massage strength constant irrespective of varying the pressing strength exerted by the user to the applicator. The massaging apparatus includes a selector which enables selectively choosing one of the above auto-controller and the pressure controller, so that the user can choose one of the above control modes as necessary, which is therefore a further object of the present invention.

The present invention further discloses the massaging apparatus with a calibrator for obtaining a pressure distribution of the monitored pressure along the length of the user. The calibrator operates to move the applicator along an up-and-down direction of the support frame in pressed contact against the user's body while keeping the applicator projected by a constant amount so as to obtain the pressure distribution over the wide range of the user's body. The apparatus includes a controller which actuates the strength-adjustor to vary the projecting amount of the applicator, based upon thus obtained pressure distribution, while moving the applicator along the user's body for giving an optimum massage strength to different portions of the user's body.

Alternately, a like calibrator is incorporated which obtains a projection distribution of the projecting amount of the applicator along the length of the user's body. The calibrator operates to move the applicator along the user's body while varying the projecting amount of the applicator in such a manner as to keep the monitored pressure at a constant level, thereby obtaining the projection distribution over the wide range of the user's body. An associated controller actuates the strength-adjustor to vary the projecting amount of the applicator, based upon thus obtained projection distribution, while moving the applicator along the user's body for giving an optimum massage strength to different portions of the user's body.

In this connection, the apparatus is configured to have a position analyzer for determining a shoulder position of the user's body based upon the pressure or projection distribution. The shoulder position is acknowledged by the apparatus or controller to differentiate the massaging actions applied to the neck and the back of the user.

Further, the controller of the apparatus may be designed to vary the projection amount of the applicator based upon a comparison result between the instantaneous monitored pressure and a predetermined pressure reference. The predetermined pressure reference is variably set for different portions of the user' body so that the applicator gives an optimum massage strength to different portions of the user's body. The variable reference pressure reference can be easily calculated with reference to the pressure or the projection distribution.

These and still other objects and advantageous features will become more apparent from the following description of the preferred embodiments when taken in conjunction with the attached drawings.

BRIEF DESCRIPTION OF THE DRAWINGS

FIGS. 33A, 33B and 33C illustrate a reversing revolution of the applicator, a motor speed varying with the changing angular position and a finger-pressure-like massage strength exerted by the applicator, respectively;

FIGS. 34A and 34B illustrate another control scheme of controlling the motor speed and the finger-pressure-like massage strength exerted by the applicator;

DETAILED DESCRIPTION OF THE EMBODIMENT

Figure 1:
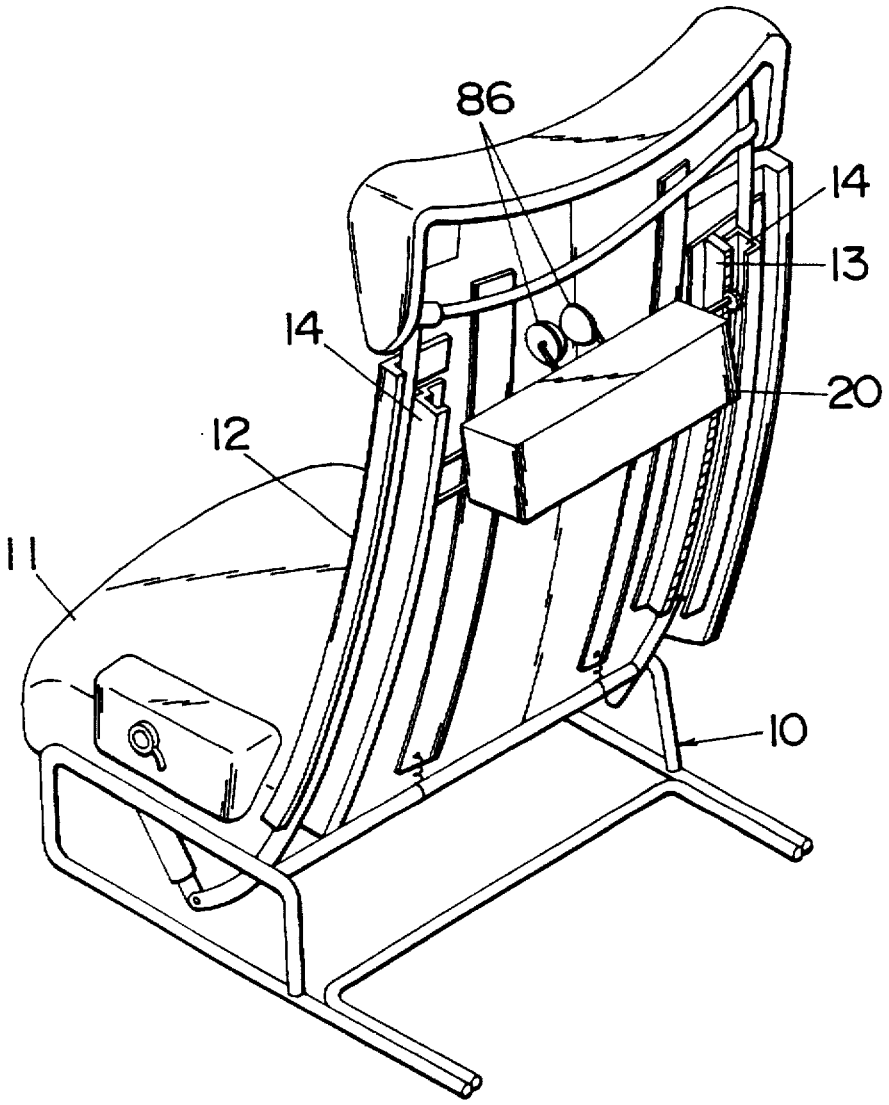
FIG. 1 is a perspective view of a massaging apparatus of the present invention.

Referring now to FIGS. 1 to 4, there is shown a massaging apparatus embodying the present invention. The apparatus comprises a supporting frame 10 in the form of a reclining chair with a seat 11 and a back 12, and a massage unit 20 carried on the back 12 to be movable in the up-and-down direction therealong. The massage unit 20 is provided on its opposite side ends with pinions 25 and rollers 26 and 27 which are engaged respectively with racks 13 and rails 14 extending along the height of the back 12 on lateral sides thereof. The pinions 25 are driven by an incorporated electric motor (not seen) to rotate in meshing engagement with the racks 13 in order to move the unit 20 along an up-and-down direction, or the height of the back 12.

Figure 2:
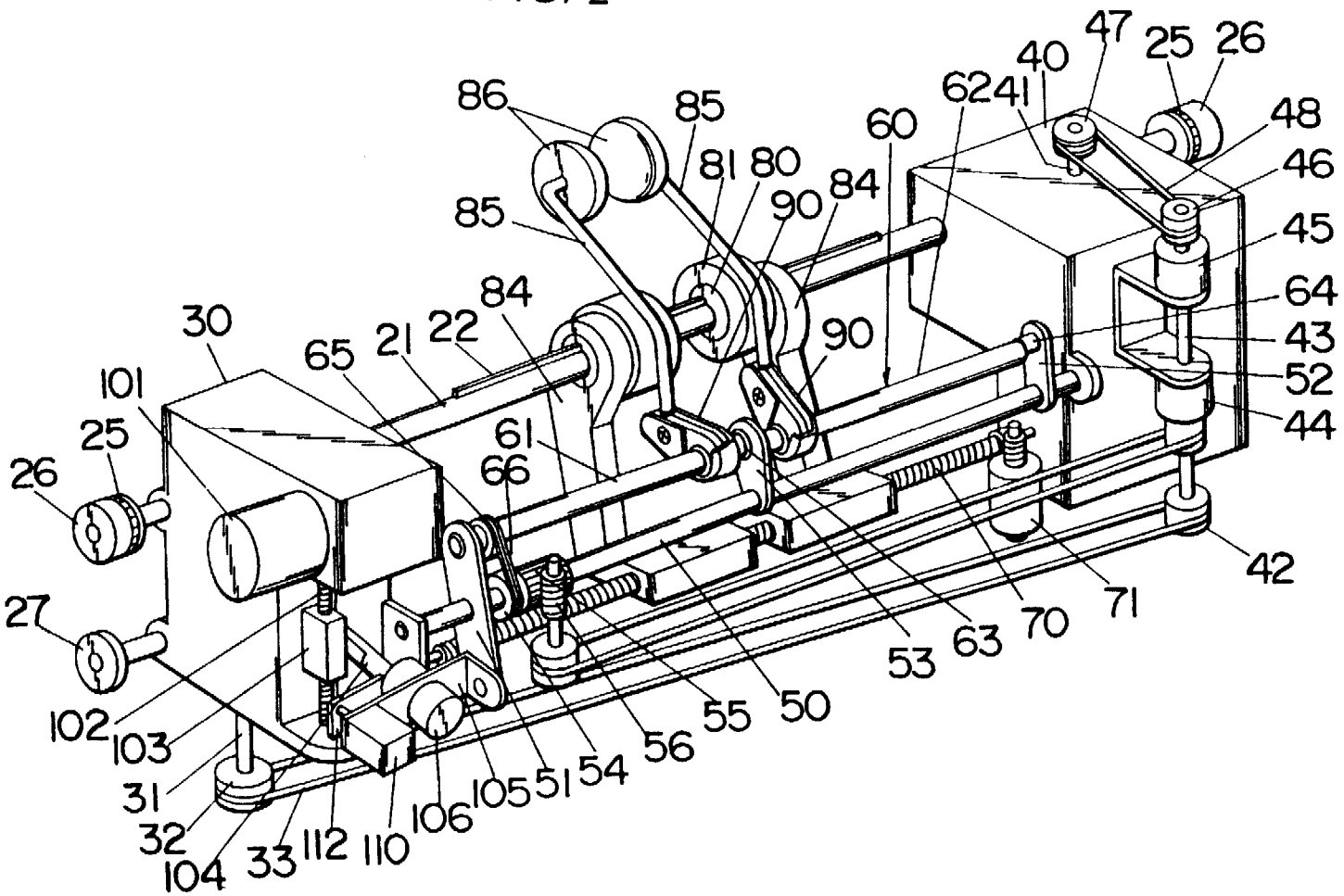
FIG. 2 is a perspective view of a massage unit of the apparatus.

As shown in FIG. 2, the unit 20 includes a motor box 30 containing the motor and a gear box 40 containing a train of gears (not shown). The motor box 30 and the gear box 40 are disposed on the opposite ends of a main shaft 21 which is selectively driven by the motor to rotate. Extending between the motor box 30 and the gear box 40 are a parallel set of a fixed shaft 50, a crank shaft 60, and a screw shaft 70. The motor has an output shaft 31 which is connected to a drive shaft 41 of the gear box 40 through a set of pulleys 32, 42 and a belt 33, clutches 44 and 45 on a clutch shaft 43, and a set of pulleys 46, 47 and a belt 48. The clutch 44 transmits the output of the motor selectively to the drive shaft 41 for rotating the pinions 25 and therefore moving the massage unit 20 along the up-and-down direction, while the clutch 45 transmits the output of the motor selectively to the crank shaft 60 for rotation about its own axis of which operation will be discussed hereinafter.

Figure 3:
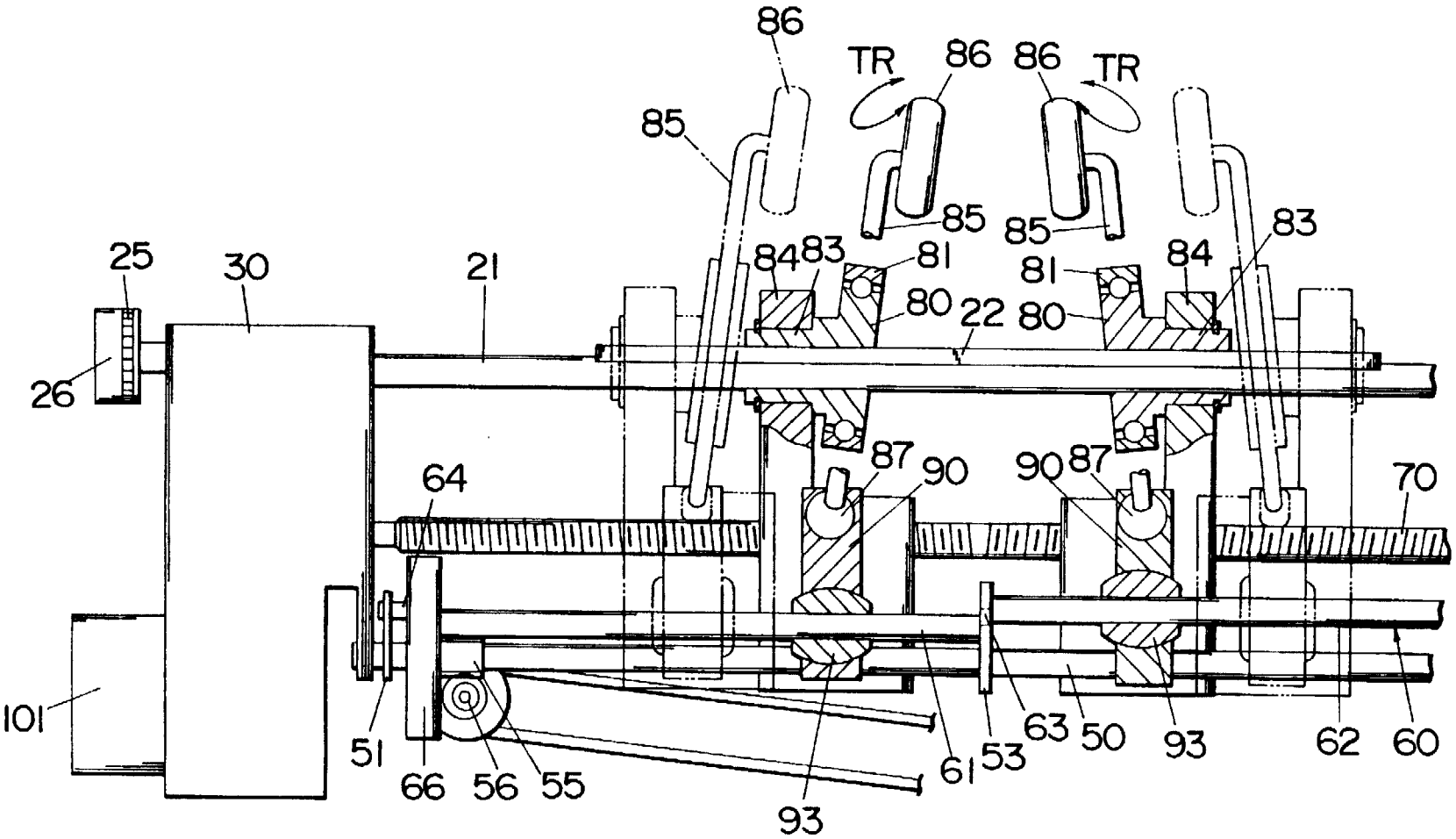
FIG. 3 is a horizontal view of a portion of the massage unit.

The main shaft 21 carries a pair of axially spaced inner wheels 80 which are eccentric and inclined with respect to an axis of the shaft 21, as best shown in FIG. 3. The inner wheel 80 is rotatively fixed to the main shaft 21 by engagement of a key 22 on the shaft 21 into corresponding slot of the inner wheel 80, while it is made axially slidable. Fitted around the inner wheel 80 is an outer wheel 81 which is coupled by means of a ball bearing to the inner wheel 80 to be freely rotatable relative thereto. The outer wheel 81 carries an arm 85 provided with its one end with a freely rotatable applicator 86 which projects on the back 12 of the frame 10 to be pressed against a user's body for applying a massaging force thereto. The arm 85 is secured at its intermediate portion to the outer wheel 81 and is connected at the end opposite to the applicator 86 to a cradle lever 90 on the crank shaft 60.

Basic massage

Figure 4:
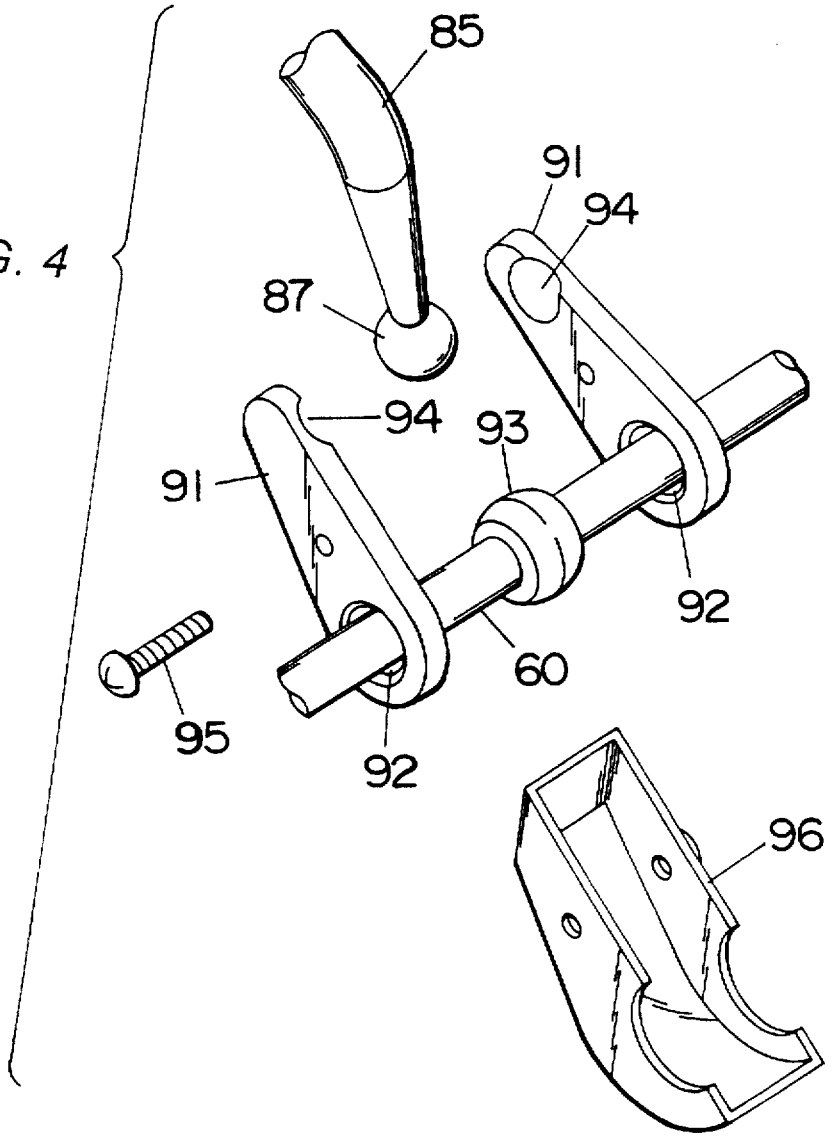
FIG. 4 is an exploded perspective view of a portion of a massage unit.
Figure 5:
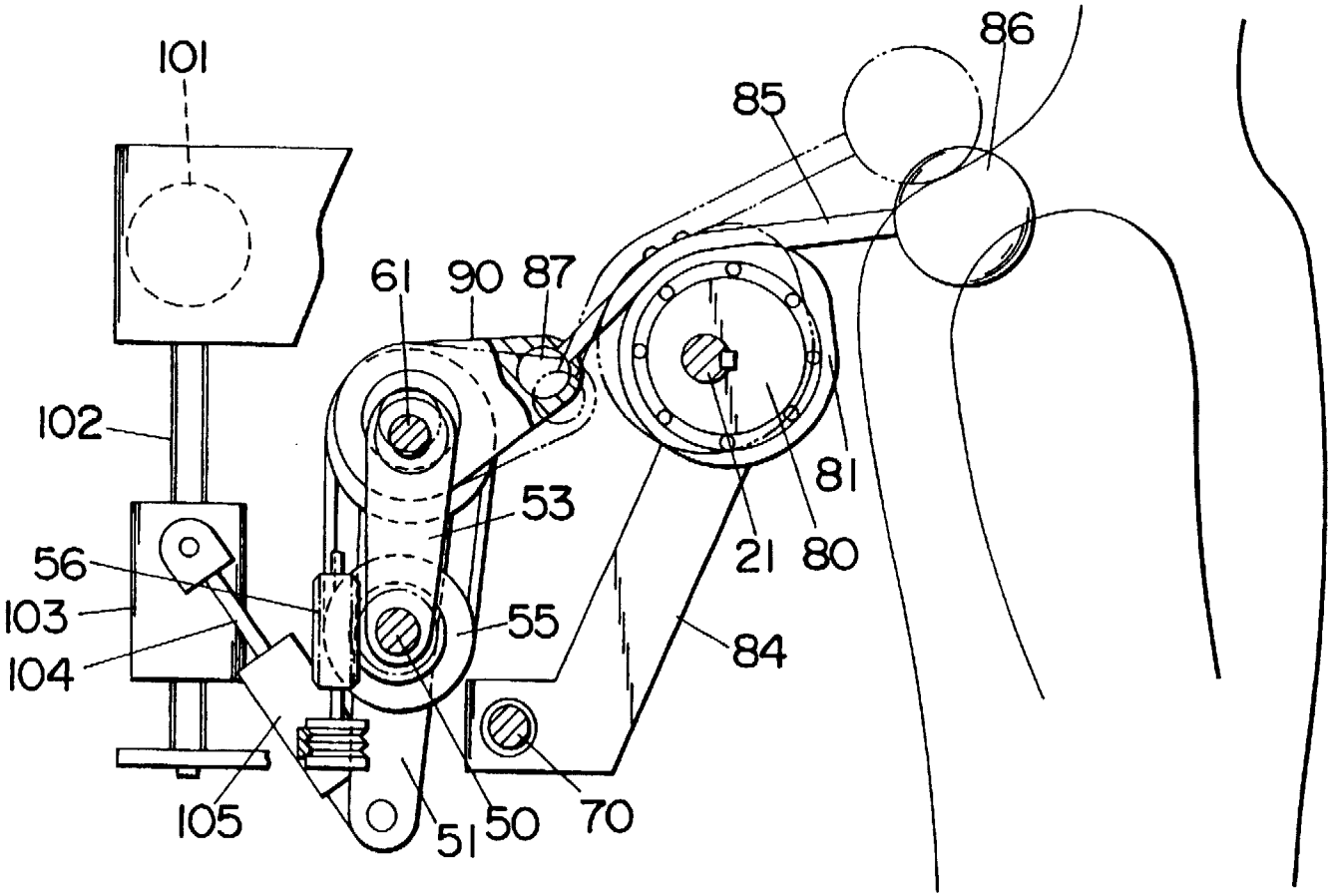
FIG. 5 is a vertical section illustrating a kneading massage effected by the massage unit.
Figure 6:
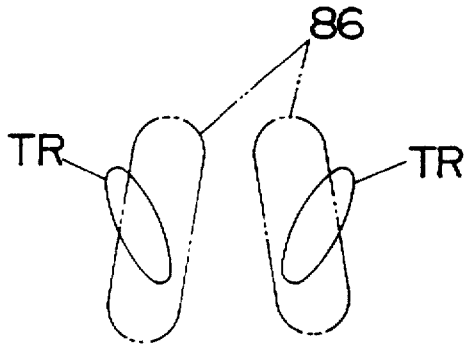
FIG. 6 is a schematic diagram illustrating a trace of applicators, as viewed from a front of the apparatus, when effecting the kneading massage.

As the main shaft 21 rotates about its axis, each inner wheels 80 undergoes an eccentric motion which is transmitted to the arm 85 for moving the associated applicator 86 to thereby apply a massaging force to the user's body. The cradle lever 90, to which the arm 85 is coupled at the end opposite to the applicator 86, comprises a pair of halves 91 carried on the crank shaft 60 by loose engagement of the shaft 60 into corresponding holes 92 of the halves 91, as best shown in FIG. 4. The halves 91 are assembled by a screw 95 to hold a ball 93 fixed to the crank shaft 60 between the halves 91 adjacent the holes such that the cradle lever 90 is permitted to move in all directions by limited extent with respect to the crank shaft 60. Further, the halves 91 have rounded recesses 94 into which a ball 87 at the end of the arm 85 is rotatably fitted so that the arm 85 can swivel at the connection to the cradle lever 90. A cover 96 is fitted to the cradle lever 90. FIG. 5 illustrates a basic massaging action with the crank shaft 60 kept stationary. As the inner wheel 80 is driven to rotate by the main shaft 21, the eccentric movement of the inner wheel 80 causes the arm 85 to move axially and radially inwardly and outwardly with respect to the main shaft 21 during which the cradle lever 90 is allowed to move in all directions with respect to the crank lever 60 to vary a supporting point of the arm 85. Whereby the applicator 86 at the free end of the arm 85 is caused to repeat a cycle of following a complicated trace TR, as moving in a direction of varying a horizonal distance and at the same time a vertical distance from the axis of the shaft 21 with associated displacement along the axis of the shaft 21, for applying the massaging force to the user's body. FIG. 6 illustrates the trace TR of the applicator 86 as viewed from the front of the apparatus. It is noted in this connection that the applicator 86 can selectively effect an up-kneading massage and a down-kneading massage by reversing the rotational direction of the main shaft 21. The up-kneading massage refers to a mode in which the applicator 86 applies substantially an upward pressing force to the user's body, while the down-kneading massages refers to a mode in which the applicator 86 applies substantially a downward pressing force.

Adjusting the spacing between the applicators 86

As shown in FIG. 3, each of the inner wheels 80 is formed integrally with a sleeve 83 concentric by the axis of the main shaft 21. The sleeve 83 is supported to a prop 84 of which the lower end is engaged with the screw shaft 70 so that the prop 84 and therefore the inner wheel 80 shift axially as the screw shaft 70 rotates. The screw shaft 70, which is driven through gears by an electric motor 71, is configured to have a pair of oppositely threaded sections each engaging with the prop of each inner wheel 80 so as to widen and narrow the spacing between the inner wheels 80, i.e., the applicators 86 by rotating the screw shaft 70 in one and the other directions.

Tapping massage

Figure 7:
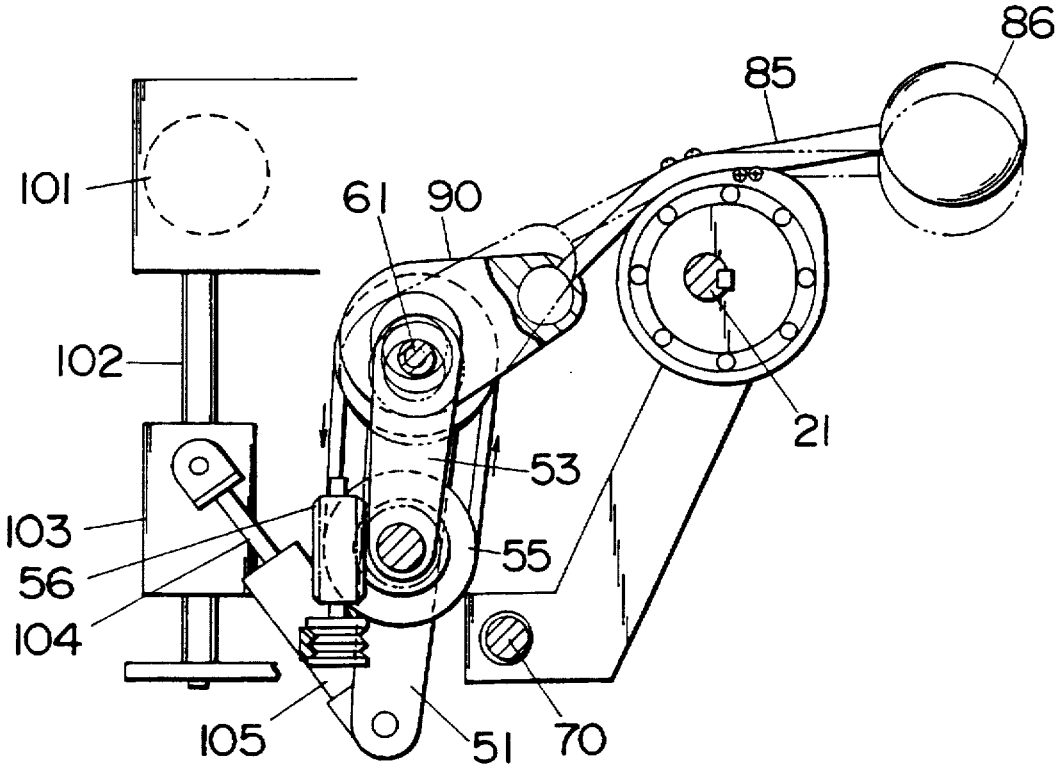
FIG. 7 is a vertical section illustrating a tapping massage effected by the massage unit.

The applicators 86 can give a tapping massage when the crank shaft 60 is rotated to positively change the supporting points of the arm 85 by the cradle lever 90 while keeping the inner wheel 80, i.e., the main shaft 21 stationary. The crank shaft 60 comprises a pair of first and second eccentric rods 61 and 62 which are oppositely eccentric to a common center axis of the crank shaft 60 and connected by a mid joint 63. Formed at the opposite longitudinal ends of the crank shaft 60 are end joints 64 which are aligned to the mid joint 63 on the common center axis. The crank shaft 60 is supported to the fixed axle 50 by means of end crank levers 51, 52 and a mid crank lever 53, respectively at the end joints 64 and the mid joint 63. The crank shaft 60 is rotatably supported to the crank levers so that it is rotatable about the common center axis. One of the end joints 64 of the crank shaft 60 has a pulley 65 which is coupled by way of a belt 66 to a pulley 54 formed on the adjacent end of the fixed axle 50 as an integral part of a gear wheel 55. The gear wheel 55 is held rotatable about the axle 50 and is in meshing engagement with a worm 56 which receives a rotary motion from the motor through the clutch 44 so as to rotate the crank shaft 60 about the center axis thereof. Referring to FIG. 7, as the crank shaft 60 rotates about the center axis thereof, the cradle lever 90 undergoes an eccentric motion at its connection with the first or second rod 61, 62, which motion is transmitted to move the applicator 86 substantially in a vertical direction to thereby develop the tapping massage force applied to the user's shoulder. It is noted that since the first and second rods 61 and 62 are oppositely eccentric or angularly displaced by 180 degrees with reference to the common center axis, the two applicators 86 effect the tapping alternately to each other in simulation of actual tapping massage by human hands. Further, by changing the angular position of the inner wheel 80 about the main shaft 21, it is possible to move the applicator 86 generally horizontally to apply the like tapping massage to the back of the user's body.

Adjusting a projecting amount of the applicator 86

Figure 8:
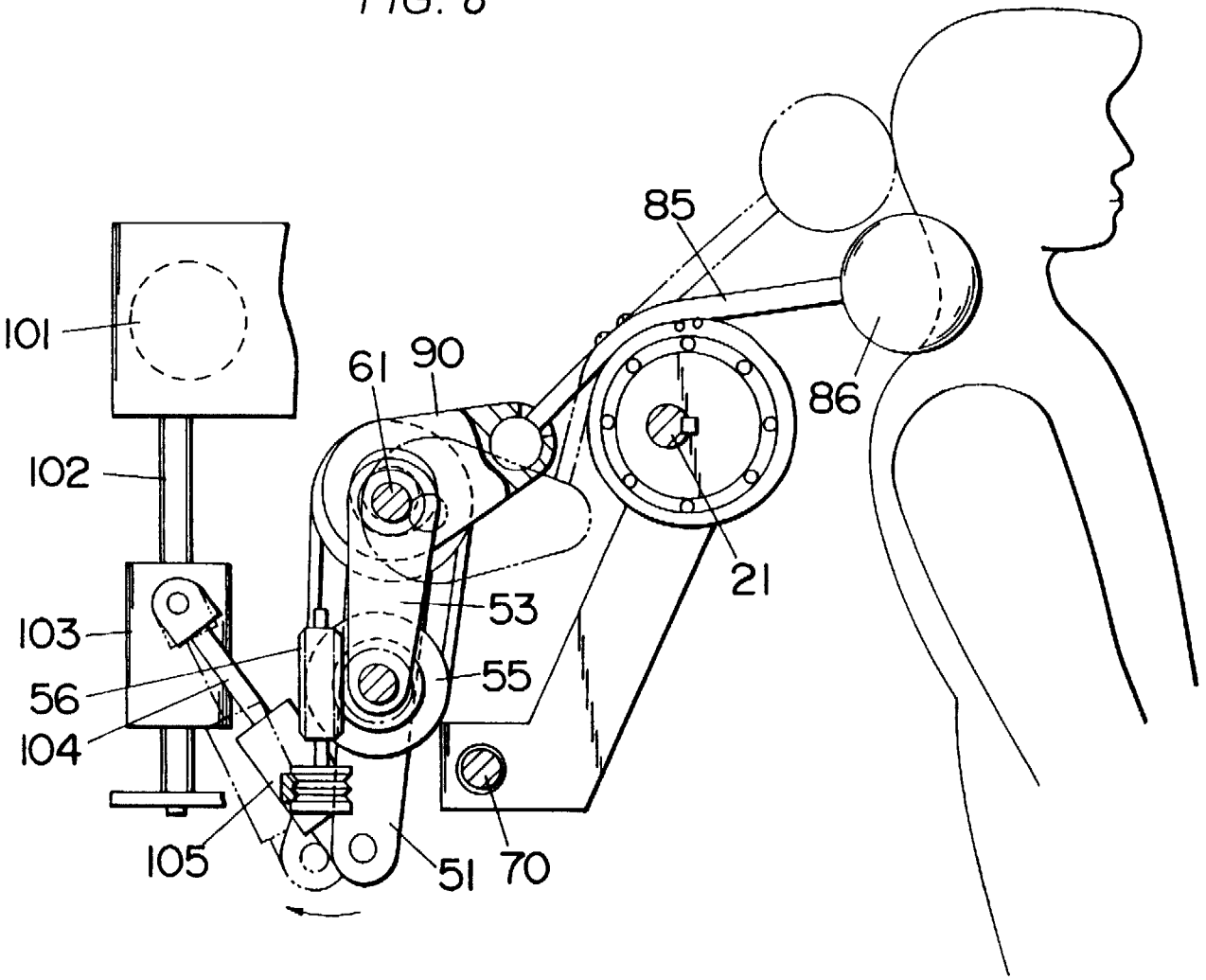
FIG. 8 is a vertical section illustrating a manner in which the massage unit recognize a pressure applied back to the applicator from a user's body.

The crank levers 51, 52 and 53 support the crank shaft 60 to the fixed axle 50 so that the crank shaft 60 is allowed to turn about the fixed axle 50 within a limited angular range. The crank lever 51 is coupled through an adjustor linkage to an electric motor 101 to be driven thereby to pivot about the axis of the fixed axle 50 for varying the angular disposition of the crank shaft 60 relative to the fixed axle 50, thereby adjusting a projecting amount of the applicators 86 along a horizontal dimension relative to the main shaft 21 or the support frame 10. As shown in FIGS. 2 and 8, the adjustor linkage comprises a feed screw 102 driven to rotate by the motor 101, a nut 103 engaged on the screw 102, and a rod 104 with a bracket 105. The rod 104 has its one end pivotally connected to the nut 103 and the other end pivotally connected to the crank lever 51 through the bracket 105 at the end of the lever 51 opposite of the connection to the crank shaft 60 from the connection to the fixed axle 50. Therefore, as the nut 103 moves along the feed screw 102, the rod 104 acts to pivot the crank lever 51 about the axis of the fixed axle 50, as shown in FIG. 8, so as to angularly displace the crank shaft 60 about the fixed axle 50 and therefore the angular orientation of the cradle levers 90 for adjusting the projecting amount of the applicator 86.

Rolling massage

The apparatus can give a rolling massage along the user's back by moving the applicators 86 in the up-and-down direction with the inner wheels 80 kept unrotated. In this mode where only the massage unit 20 is driven to move for stretching across the user's back by rolling contact of the applicators, the projecting amount of the applicators 86 and the spacing between the applicators 86 can be suitably adjusted by the above mechanisms for effectively stretching along the back of the user.

Pressure sensor

Figure 9:
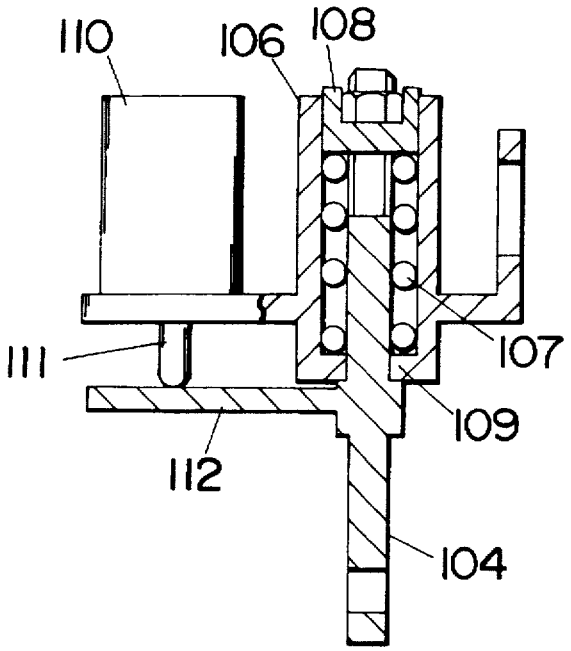
FIG. 9 is a sectional view of a pressure sensor for monitoring the pressure applied to the applicator from the user's body.

The apparatus includes a pressure sensor 110 for monitoring a counter-pressure which is applied back to the applicator 86 as a counter-action of exerting the massaging force to the user's body. The pressure sensor 110 is a displacement gauge carried on the bracket 105 of the adjustor linkage and has a probe 111 of which tip is kept in contact with a plate 112 integral with the rod 104, as shown in FIGS. 2 and 9. The bracket 105 is formed with a cylinder 106 into which the one end of the rod 104 extends slidably. A coil spring 107 is disposed on the rod 104 within the cylinder 106 between a retainer 108 at the end of the rod and an inner flange 109 of the cylinder 106. When the applicator 86 receives the counter-pressure from the user's back, the crank shaft 60 responds to turn about the fixed axle 50 in a counter-clockwise direction as viewed in FIGS. 2 and 8, thereby pulling the bracket 105 away from the rod 104 while compressing the spring 107. This displacement of the bracket 105 relative to the rod 104 or the compression amount of the spring 107 is monitored by the pressure sensor 110 which provides an electric signal indicative of the counter-pressure applied back to the applicator 86. The signal from the sensor 110 is fed to a controller which controls an overall operation of the apparatus.

Figure 10:
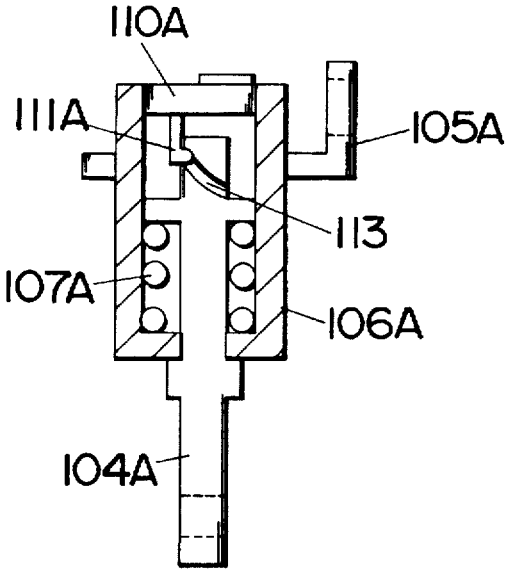
FIG. 10 is another pressure sensor which may be utilized instead of the pressure sensor of FIG. 9.

FIG. 10 illustrates another pressure sensor 110A which may be utilized instead of the above sensor 110. The sensor 110A is the form of a variable resistance gauge with a probe 111A fitted in the end of a like cylinder 106A. The probe 111A has its tip engaged in into a helical groove 113 so as to convert the axial movement of the rod 104 relative to the cylinder with an associated compression of the spring 107A into a rotary movement of the probe 111A, which is then converted into an electric output from the sensor 110A indicative of the counter-pressure applied back to the applicator 86. It is equally possible to use a like strain gauge in the adjustor linkage for monitoring the counter-pressure. Further, the counter-pressure can be measured by monitoring a motor current which varies in accordance with a load applied to the motor responsible for applying the massaging force to the user.

Massage control

Figure 11:
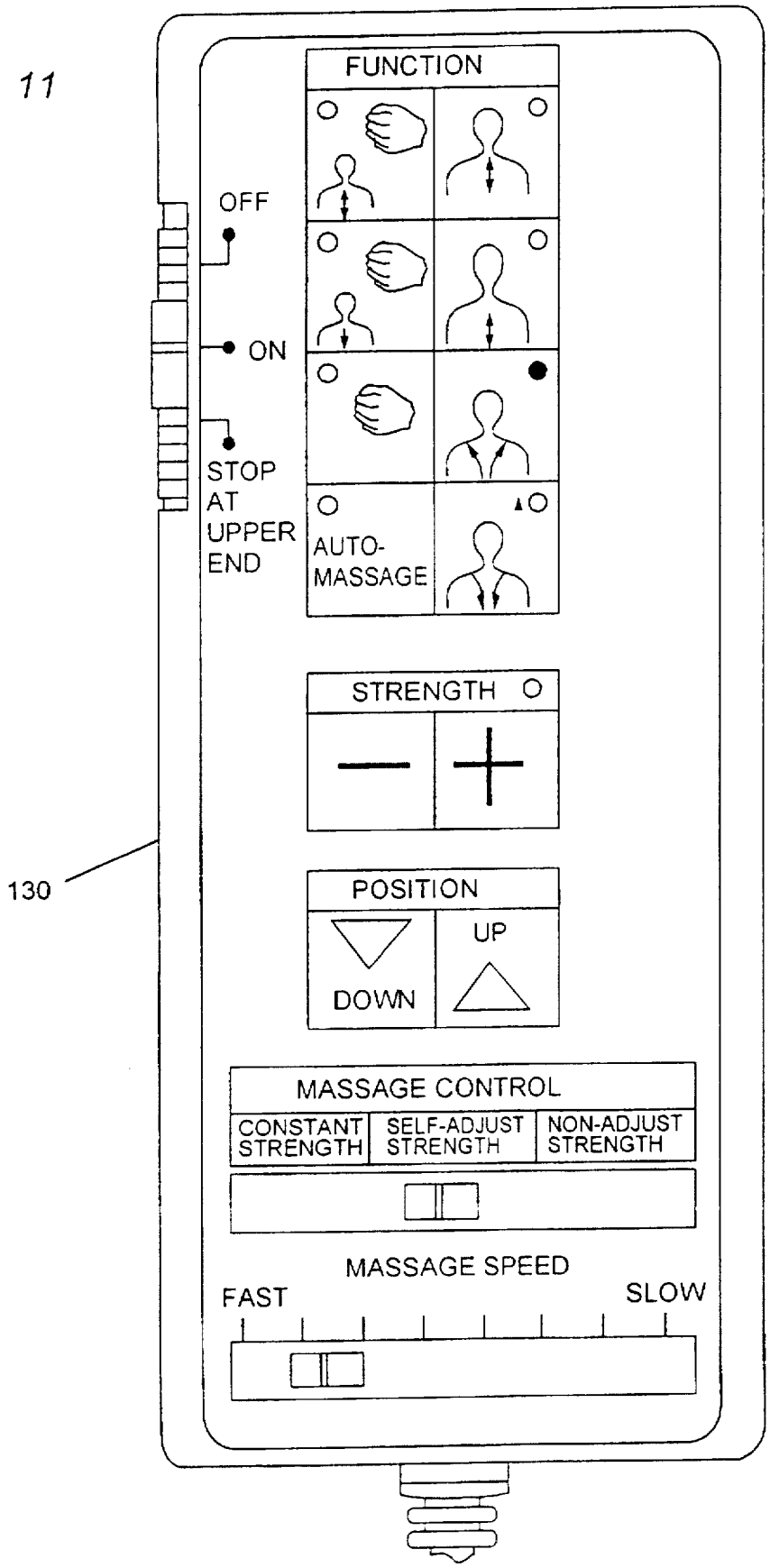
FIG. 11 is a plan view of a remote controller unit of the apparatus.
Figure 12:
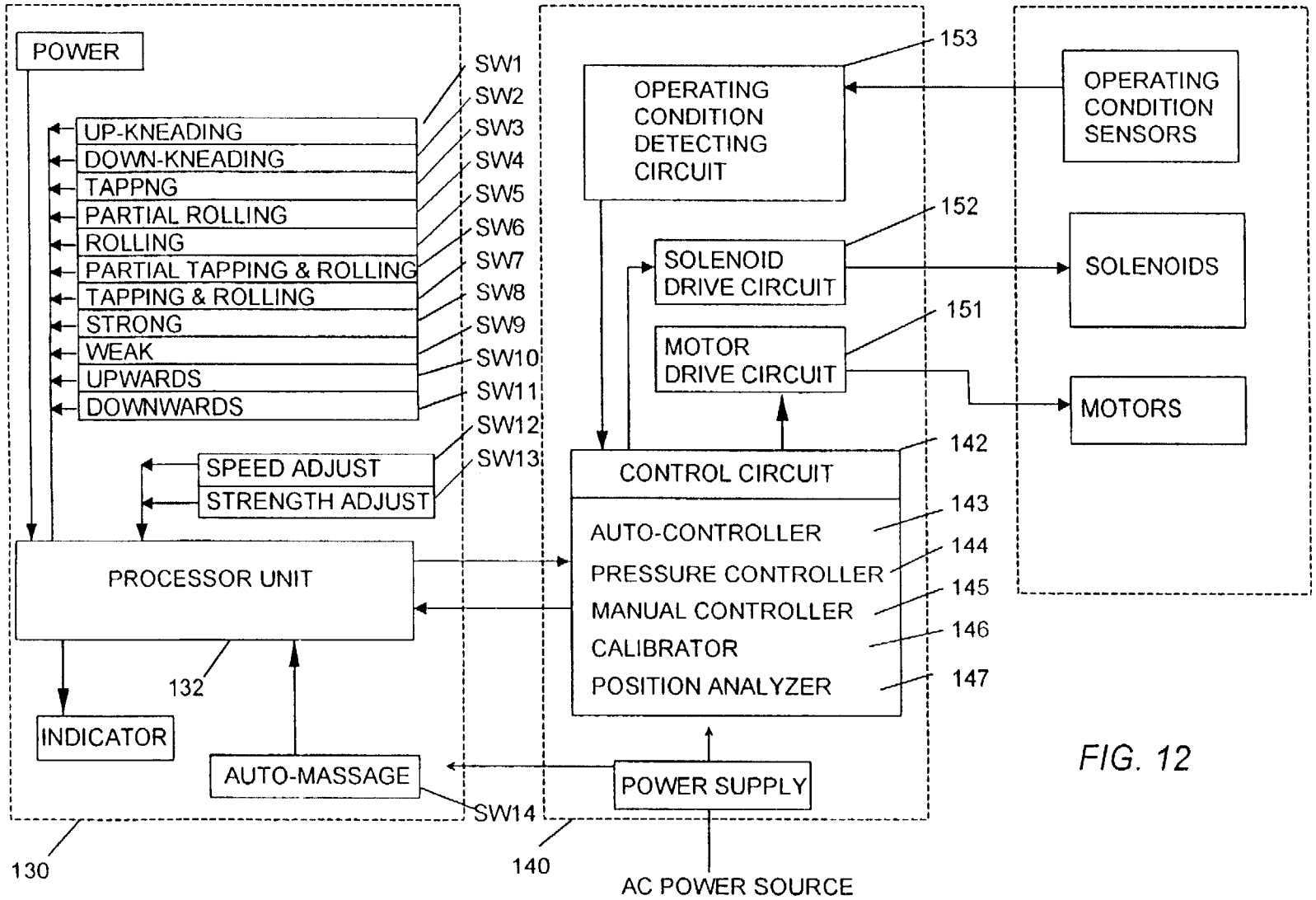
FIG. 12 is a block diagram of an operation system of the apparatus.

The apparatus includes a remote-controller 130, as shown in FIG. 11, by which the user can select a desired massaging mode from a variety of combinations of the massage strength, speed, massaging area, etc. To this end, the remote-controller 130 includes, as shown in FIG. 12, a plurality of selection switches $SW_1$ to $SW_{13}$ and a processing unit 132 which generates and transmits a control signal in the form of a digital signal indicative of the selected massage mode to a control circuit 142 in a circuit section 140 provided in the massage unit 10. The control circuit 142 is connected through a motor drive circuit 151 to control the individual motors for reciprocating the massage unit 20 along the up-and-down direction, reversing the applicator movement, varying the projection amount of the applicators 86 to adjust the massage strength, adjusting the spacing between the applicators 86. Also, the control circuit 142 is connected through a solenoid drive circuit 152 to control solenoids of the clutches 44 and 45 respectively for allowing the massage unit 20 to move relative the frame 10 and for enabling the tapping massage. Further, the control circuit 142 is connected to an operating condition detecting circuit 153 which is coupled to a plurality of sensors including the above pressure sensor 110 and position sensors for monitoring the operating conditions of the apparatus. Basically, the control circuit 142 gives three modes, i.e., self-adjust strength mode, constant strength mode, and a non-adjust strength mode, in accordance with the selection of the user by the remote-controller 130.

1) Self-adjust strength mode

Figure 14:
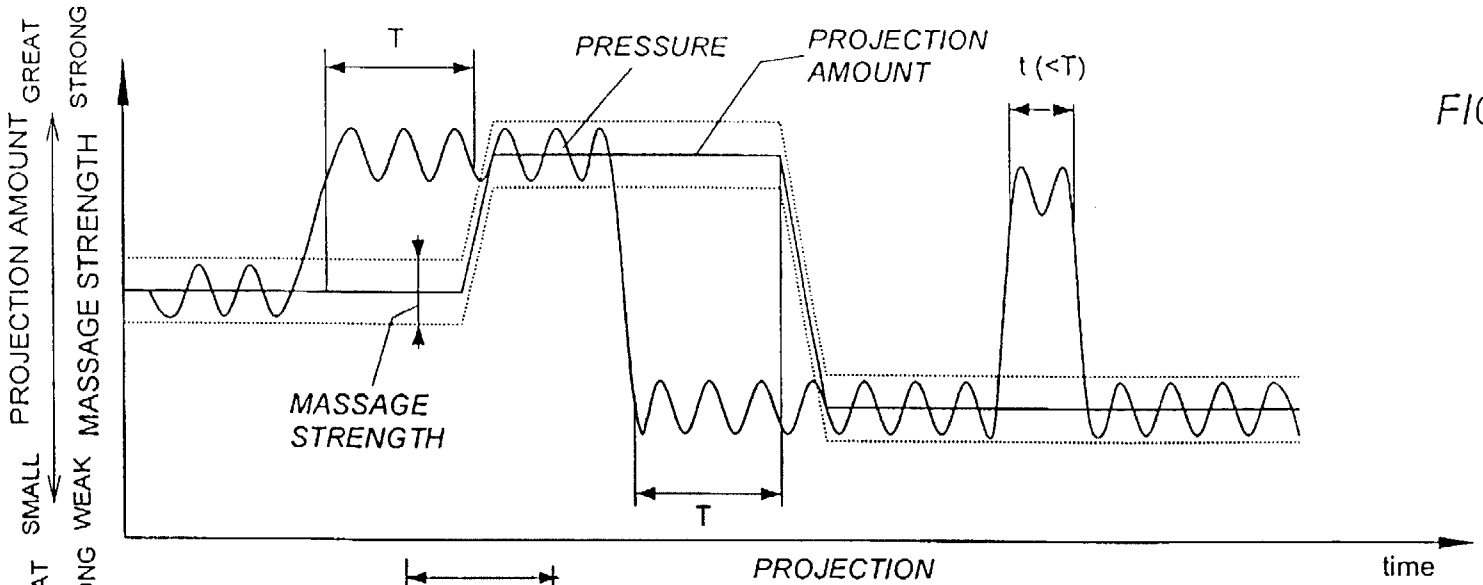
FIG. 14 is a graph illustrating a relationship between the massage strength and a projecting amount of the applicator when the apparatus operates in an self-adjusting variable strength mode for varying the massage strength in such a manner as to follow the pressure applied back to the applicator.

In this mode, an auto-controller 143 in the control circuit 142 operates to vary the projection amount of the applicators 86 in a direction of following the pressure monitored by the pressure sensor 110, as shown in FIG. 14. In operation, the auto-controller 143 first acknowledges a current massage strength selected by the user, i.e. the selected set-value of the massage strength and compares that strength with the monitored pressure. When the monitored pressure deviates from the current massage strength continuously over a predetermined time period T, the auto-controller 143 responds to adjust the projection amount of the applicators 86 in order to balance the massage strength with the monitored pressure. That is, when the user pushes one's back strongly against the applicators 86, an automatic control is made to increase the massage strength. On the other hand, when the user wishes to lower the massage strength, the user is simply required to weaken the pressing against the applicators 86 to effect the adjustment even without resorting to manipulate the remote-controller. In order to give a consistent and comfortable control free from temporarily variations in the monitored pressure, the above auto-control ignores the temporarily pressure variations within a short time period t (<T), as shown in FIG. 14. The deviation of the monitored pressure from the currently set massage strength is determined when there is at least a critical difference therebetween.

2) Constant strength mode

Figure 15:
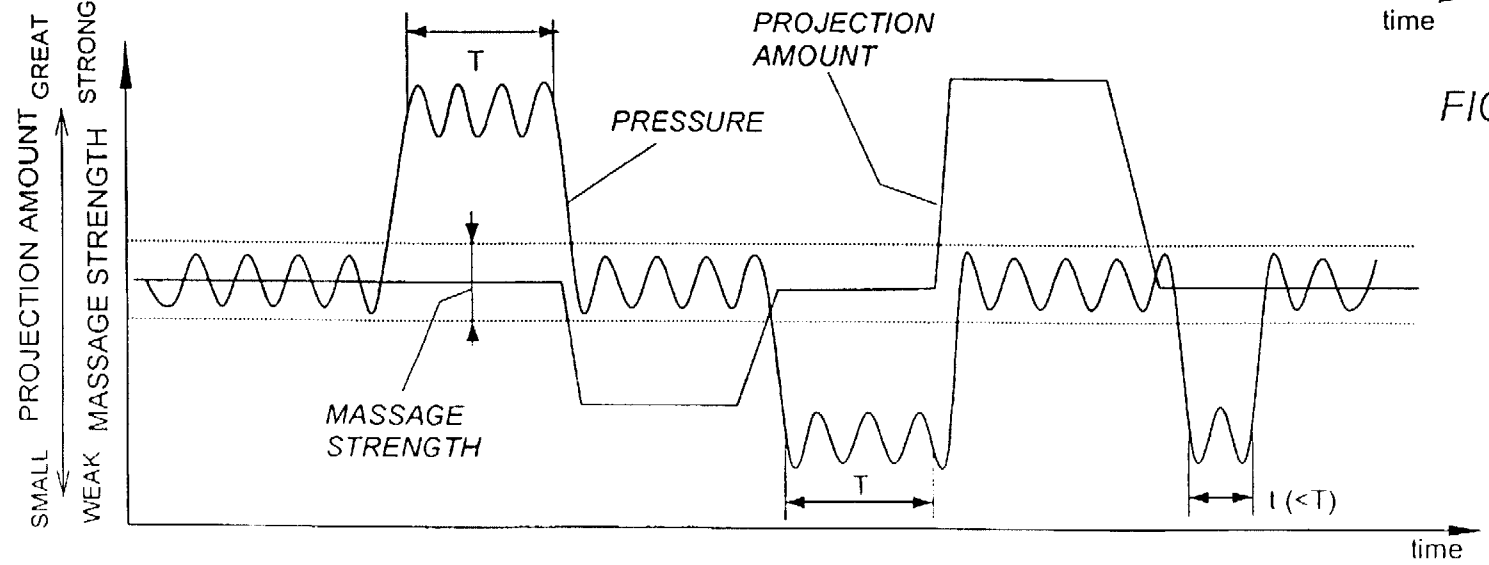
FIG. 15 is a graph illustrating a relationship between the massage strength and a projecting amount of the applicator when the apparatus operates in a fixed strength mode.
Figure 16:
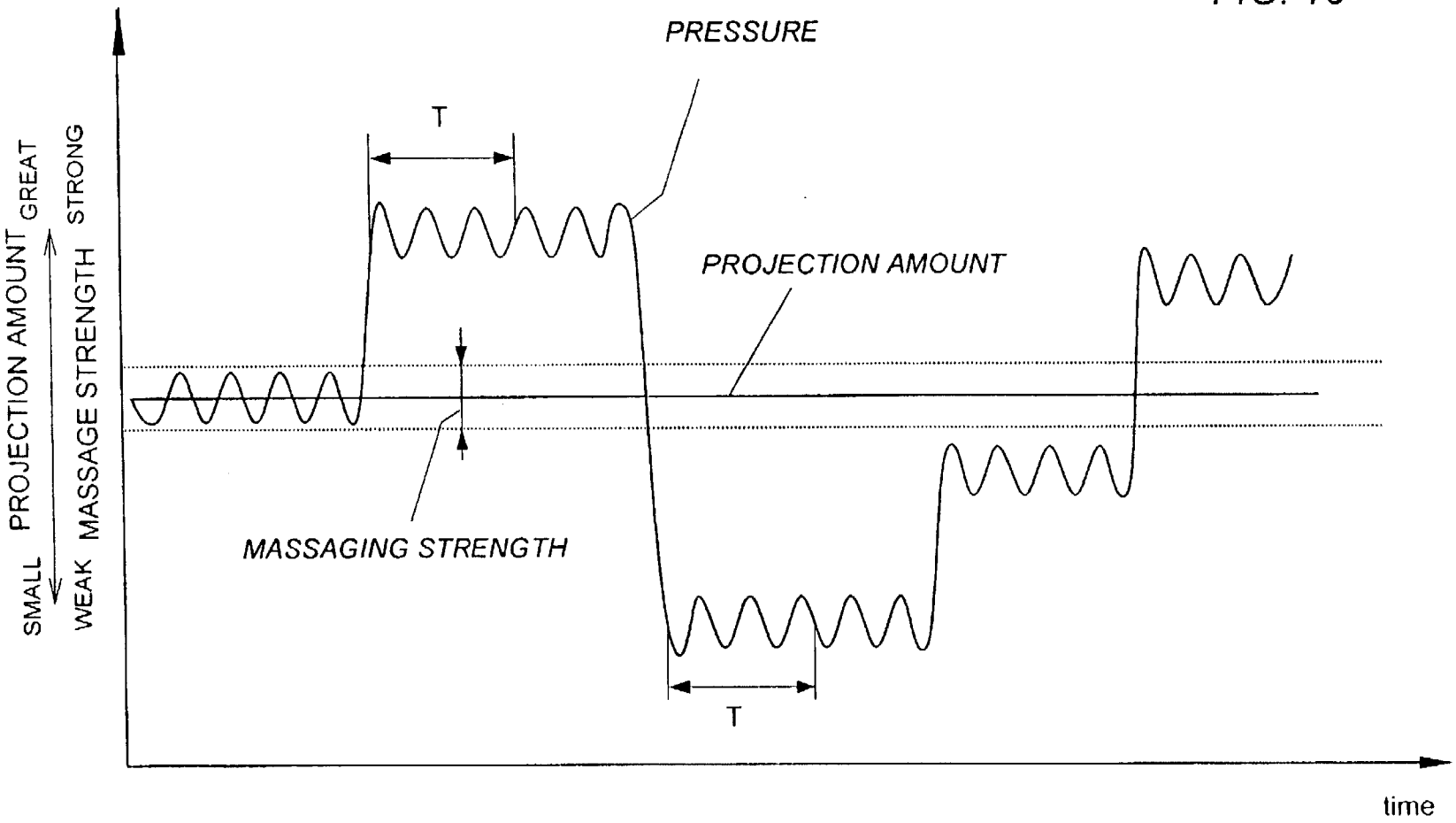
FIG. 16 is a graph illustrating a relationship between the massage strength and a projecting amount of the applicator when the apparatus operates in an non-adjusting mode.

In this mode, a pressure controller 144 in the control circuit 142 operates to keep the massage strength at a constant level selected by the user. As shown in FIG. 15, when the monitored pressure deviates from the current massage strength continuously over a predetermined period T, the controller 144 responds to increase or decrease the projection amount of the applicators 86 to adjust the massage strength in level with the selected strength. Also in this mode, the controller 144 ignores a temporary pressure variation within a short time period t (<T).

3) Non-adjust strength mode

When this mode is selected, no control is made by the control circuit 142 based upon the monitored pressure so that the projection amount of the applicators 86 is kept fixed.

Figure 13A:
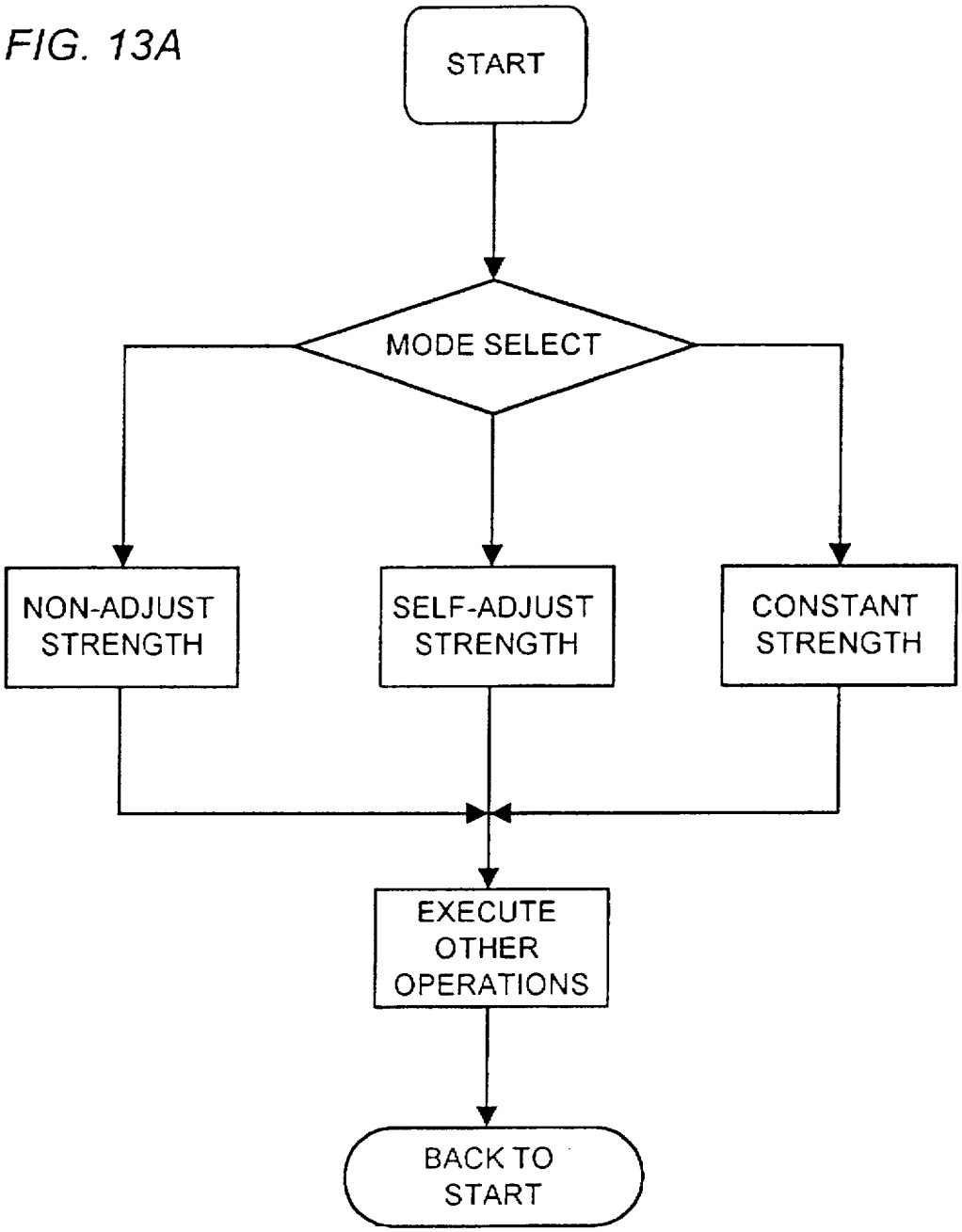
FIGS. 13A to 13C are flow charts illustrating the operation of the apparatus.
Figure 13B:
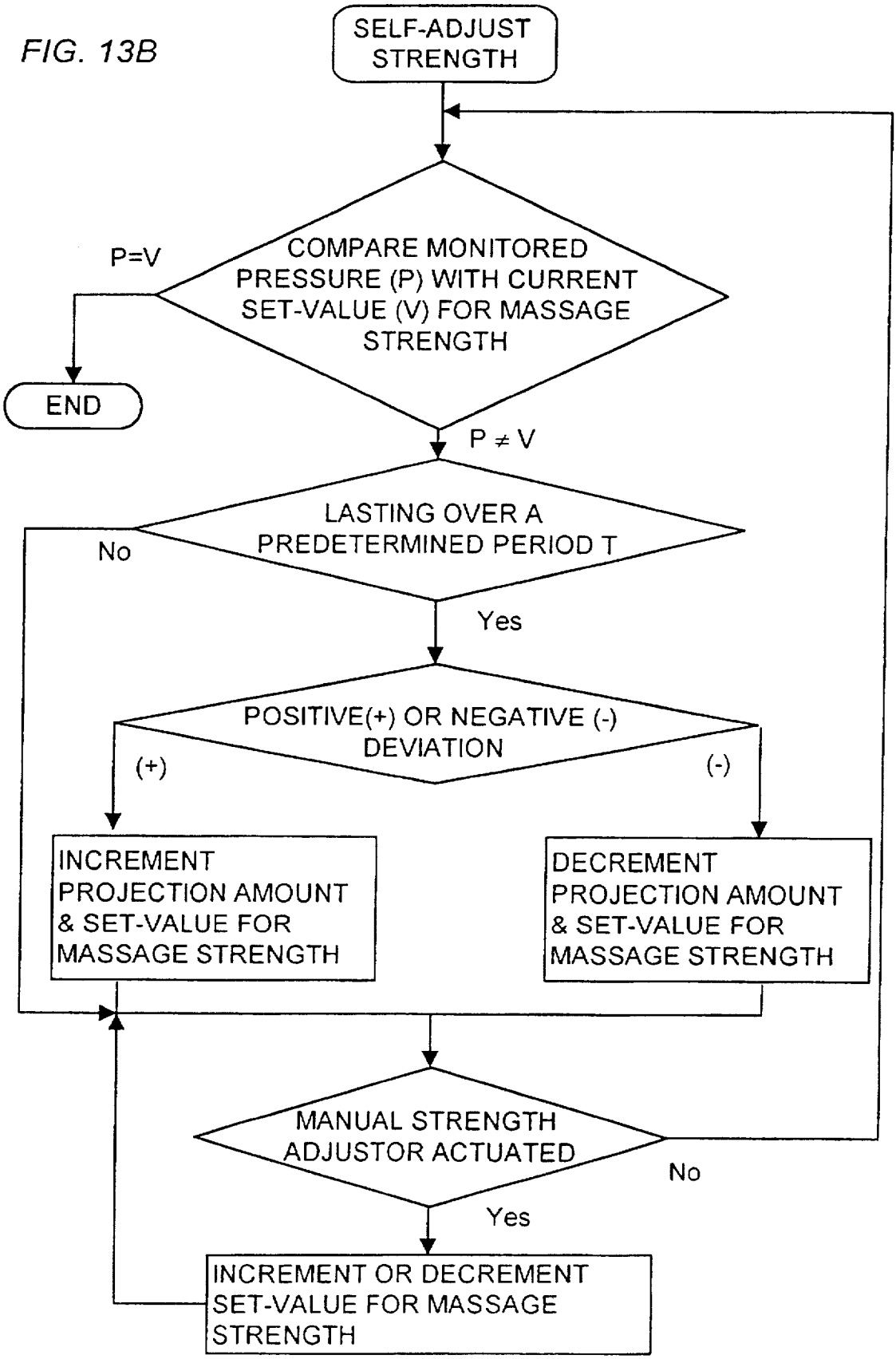
Figure 13C:
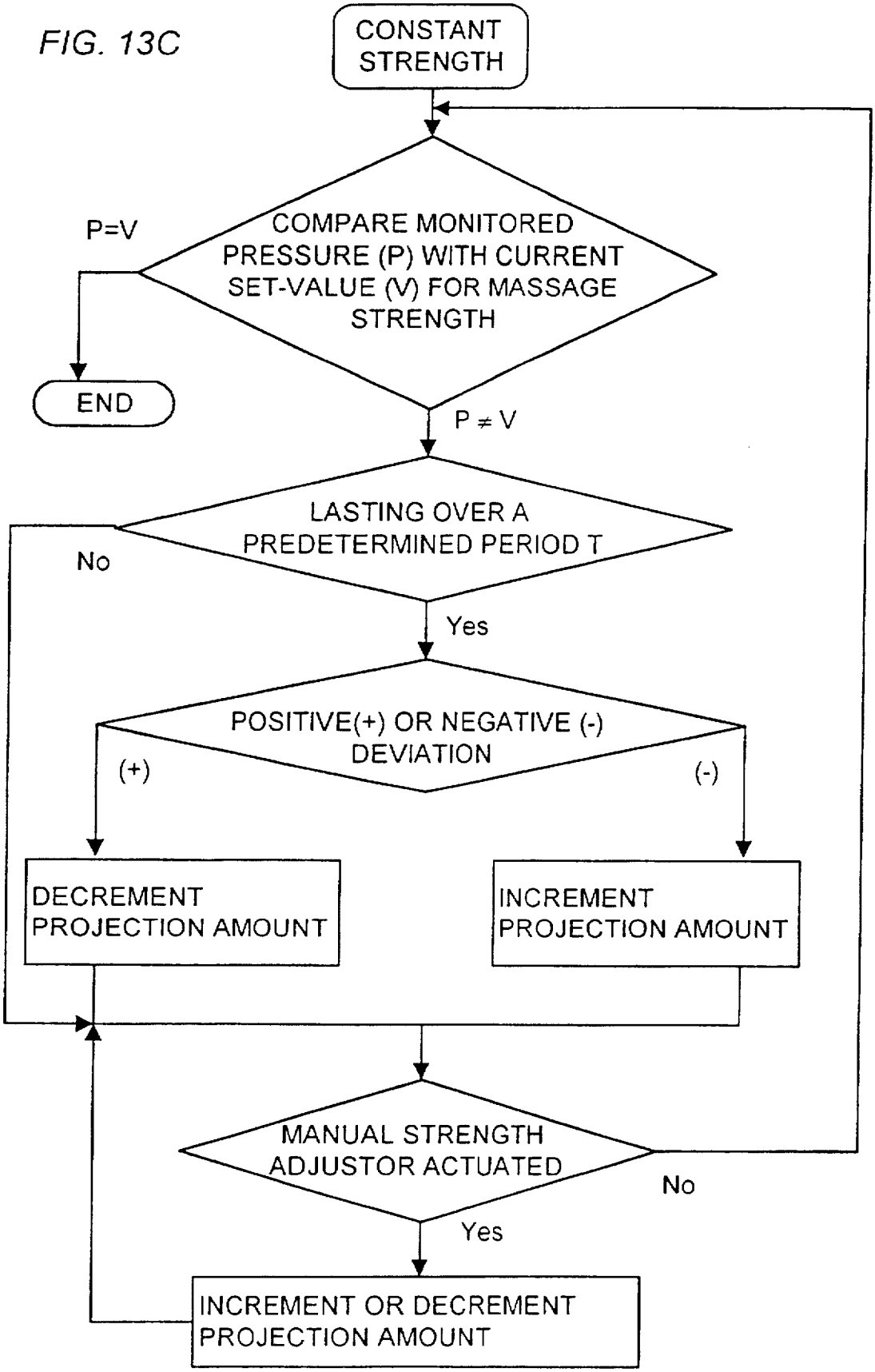

It is noted in this connection that the control circuit 142 updates the massage strength adjusted in the above self-adjust strength mode so that the user can use this massage strength after changing the massage mode from the self-adjust mode to the others. The above operation sequence is shown in the flow charts of FIGS. 13A to 13C.

Figure 17:
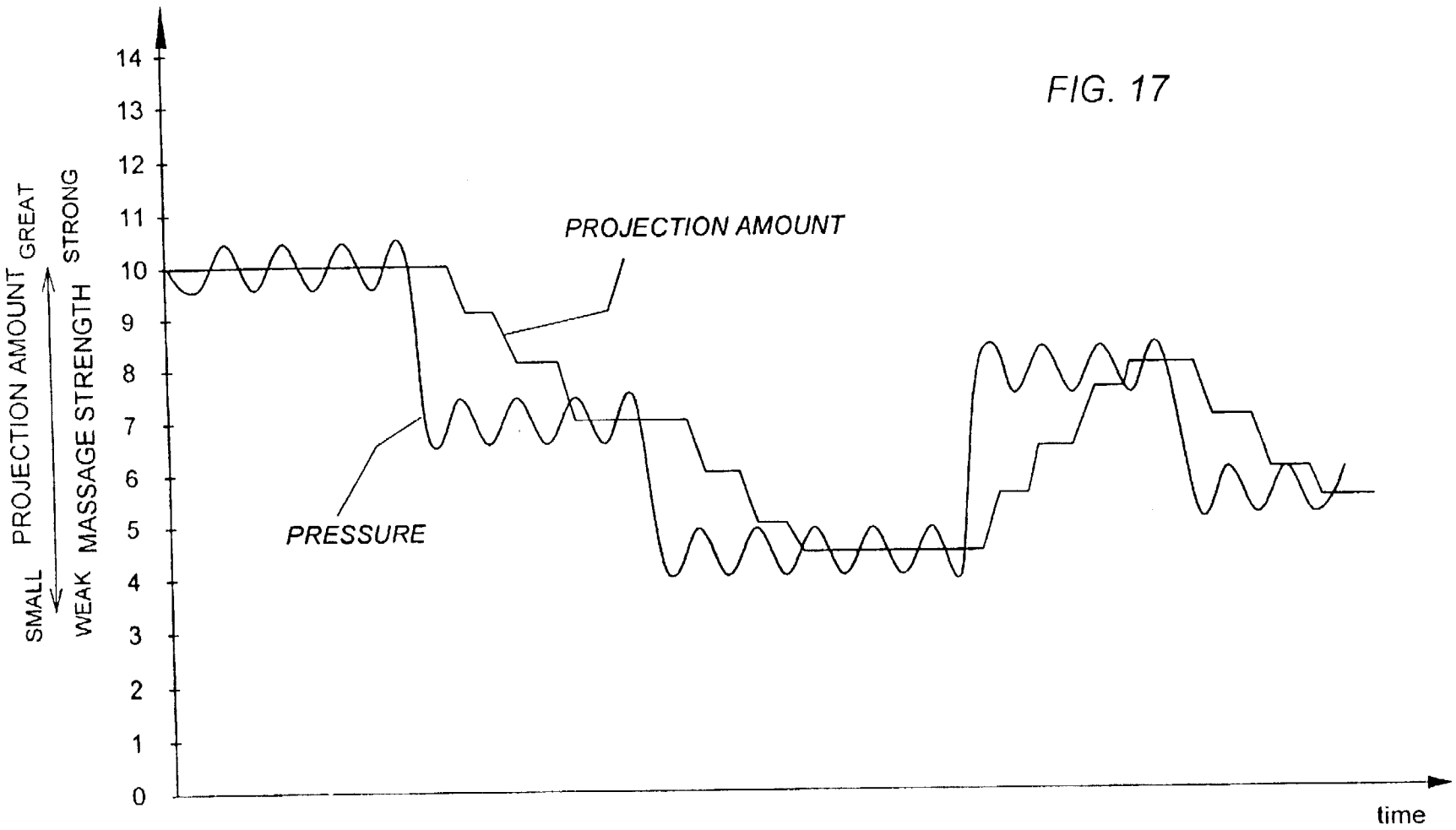
FIGS. 17 and 18 are graphs respectively illustrating self-adjusting controls for gradually and promptly adjusting the massage strength to the monitored pressure.
Figure 18:
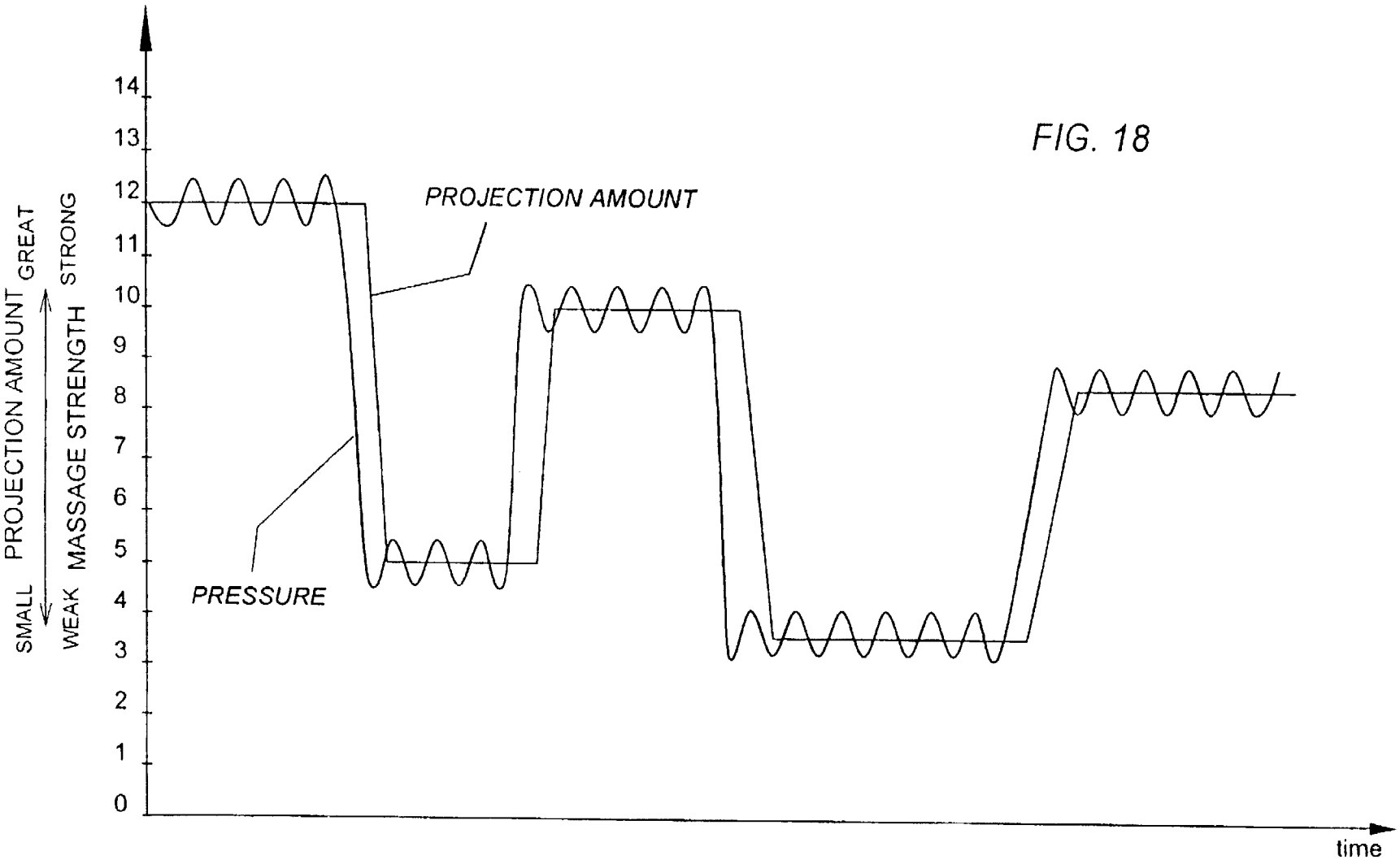

The above self-adjust strength mode is realized in such a manner as to decrement and increment the projection amount of the applicators by a predetermined level or step, as shown in FIG. 17, until the projection amount reaches the monitored pressure. When the control circuit 142 acknowledges a considerably great difference between the monitored pressure between the projection amount, it can operate to adjust the projection amount promptly by a single step, as shown in FIG. 18. Although the massage strength is adjusted by varying the projection amount of the applicators 86 in the above embodiment, it is equally possible to vary an operational speed of the motor singly or in combination with the projection amount for adjusting the massage strength. Further, the self-adjust control may be alternately made in response to the monitored pressure level itself, or the change rate thereof in order to effect a more consistent control on a weighting basis, such as by adjusting the massage strength to some extent in a direction of narrowing the difference between the monitored pressure and the massage strength rather than balancing thereof, or by adjusting the massage strength beyond the monitored pressure.

Figure 19:
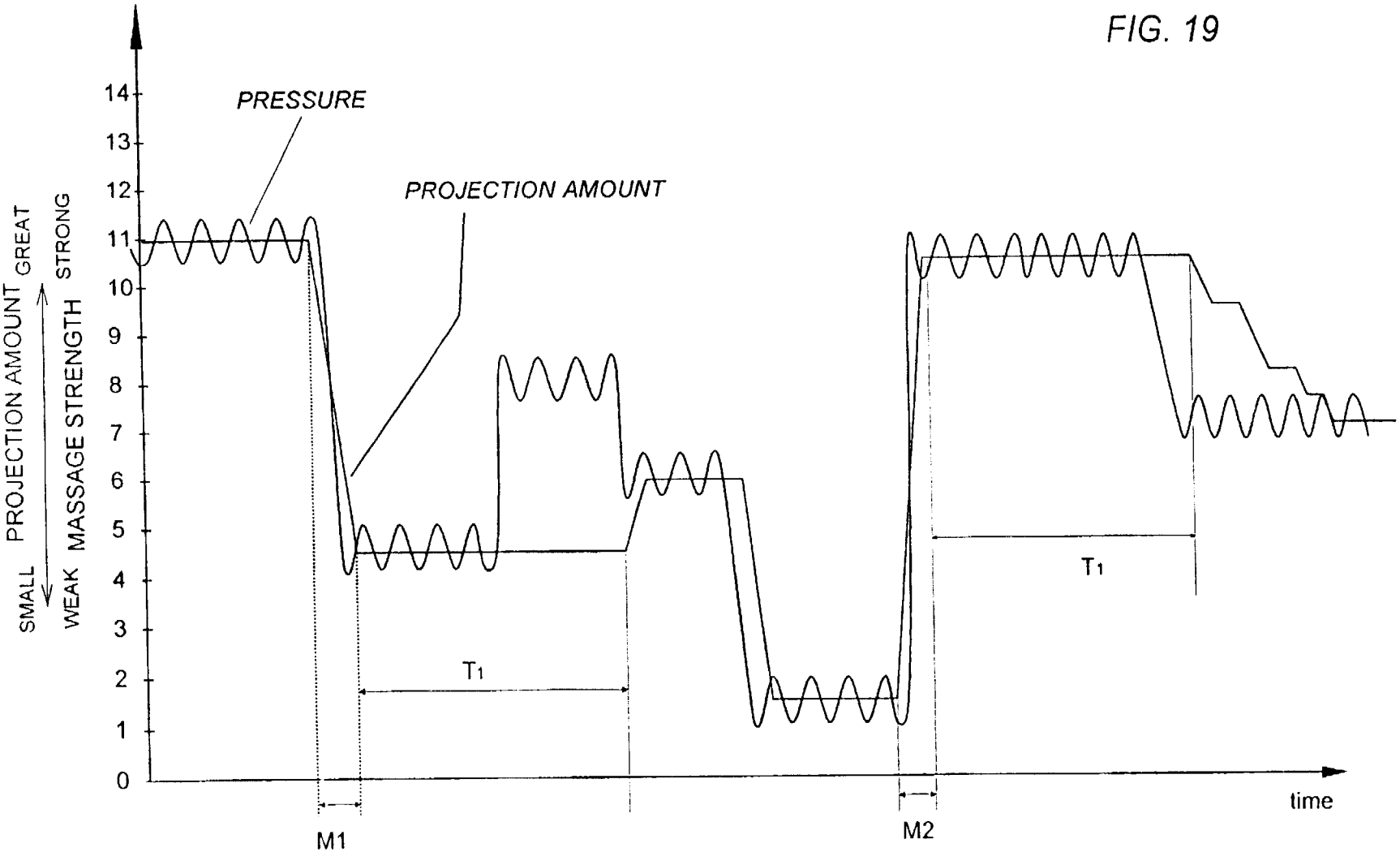
FIG. 19 is a graph illustrating a combination of a self-adjusting control and a manual control for adjusting the massage strength.

The control circuit 142 permits a manual adjustment of the massage strength entered at the remote-controller 130. When the manual adjustment is made to vary the projection amount of the applicators, as shown in FIG. 19, at timings indicated respectively by M1 and M2, a manual-controller 145 in the control circuit 142 sets a rest-period T1 in which it does not respond to adjust the massage strength even when there is found such a difference between the monitored pressure and the current massage strength that would otherwise cause the self-adjust control. After the elapse of the rest-period T1, the controller 145 can respond to adjust the massage strength in accordance with the difference between the monitored pressure and the current massage strength. In this manner, the intended manual adjustment can be made successfully without being interrupted by the self-adjusted control.

The apparatus is preferred to include an audio device which issues a voice or sound informing the user of the change of the massage strength being made and the new massage strength selected for confirmation.

Analysis of a user's back contour and a shoulder position

Figure 20B:
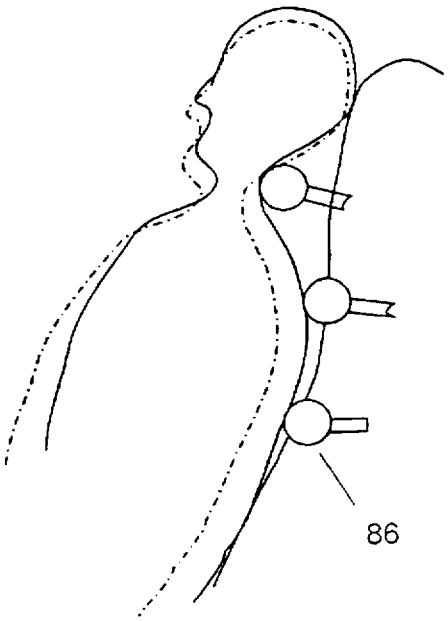
FIGS. 20A and 20B illustrate a pressure distribution along the length of the user's back and a manner of moving the applicator for obtaining the pressure distribution, respectively.
Figure 20A:
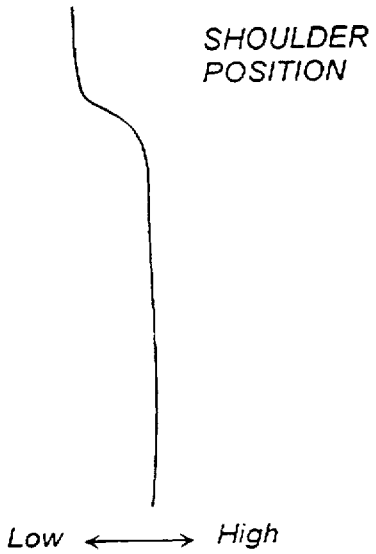
Figure 21:
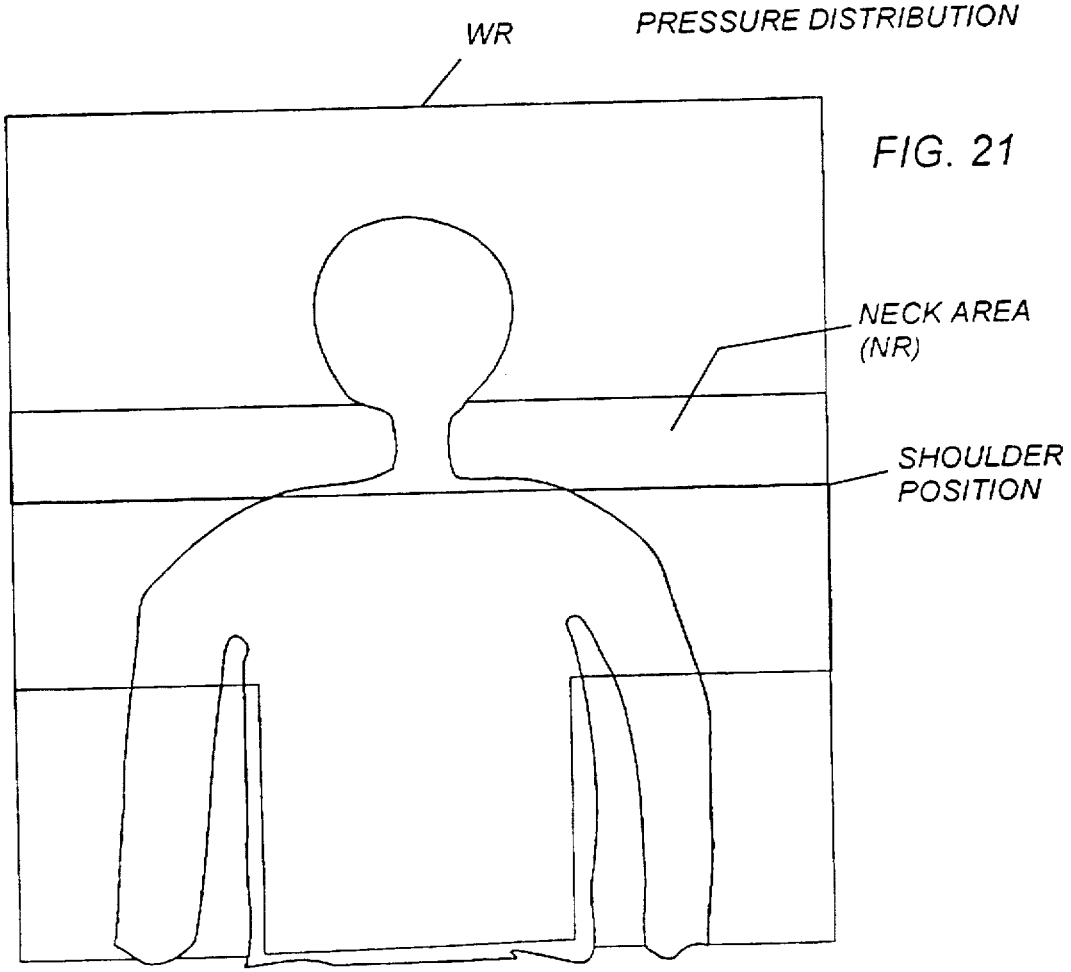
FIG. 21 is a schematic diagram illustrating a range over which the applicator can apply the massage to the user's back.

The control circuit 142 has a calibrator 146 which is capable of determining a contour of the user's back so that the control circuit 142 can control to vary the massage strength from portions to portions of the user's back in accordance with the contour. The contour can be obtained in terms of a pressure distribution of the counter pressure which is applied back to the applicators 86 while moving the applicators along the user's back at a fixed projection amount, as shown in FIGS. 20A and 20B. In particular, the calibrator 146 includes a position analyzer 147 which judges a shoulder position indicative of the user's shoulder based upon the pressure distribution of FIG. 20A. The shoulder position is utilized by the control circuit 142 to designate a neck region NR within a limited distance upwardly from the shoulder position, as shown in FIG. 21, even the applicators 86 are made capable of moving over a wide range WR beyond the neck region, so that the applicators are prohibited to move beyond the neck region NR for avoiding a danger of applying a pressing force to the user's head. The position analyzer 147 determines the shoulder position in the manner as follows.

Figure 23:
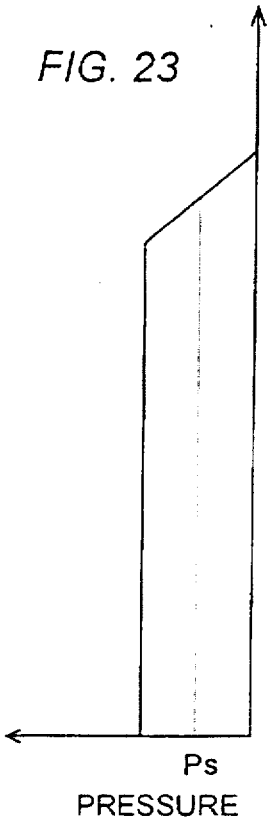
FIGS. 23 to 26 illustrates individual schemes of determining a shoulder position of the user.
Figure 24:
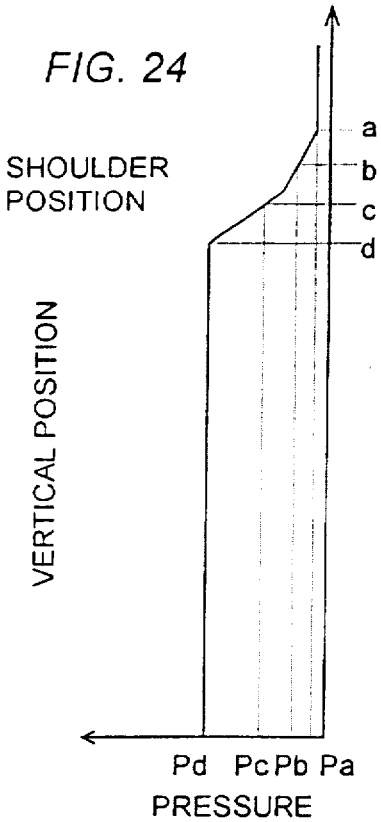
Figure 25:
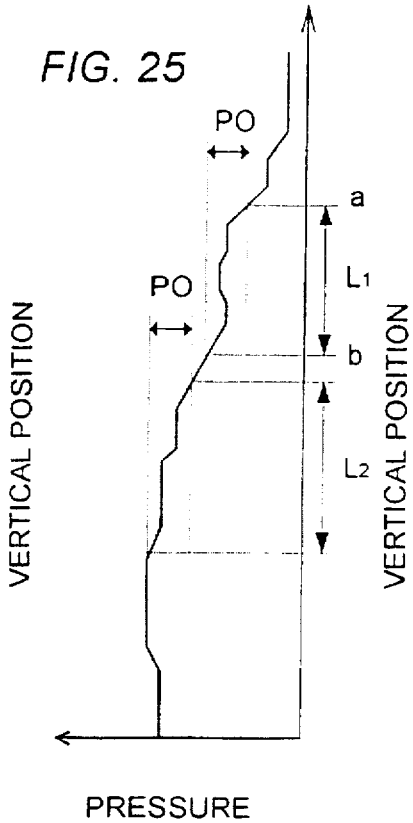
Figure 26:
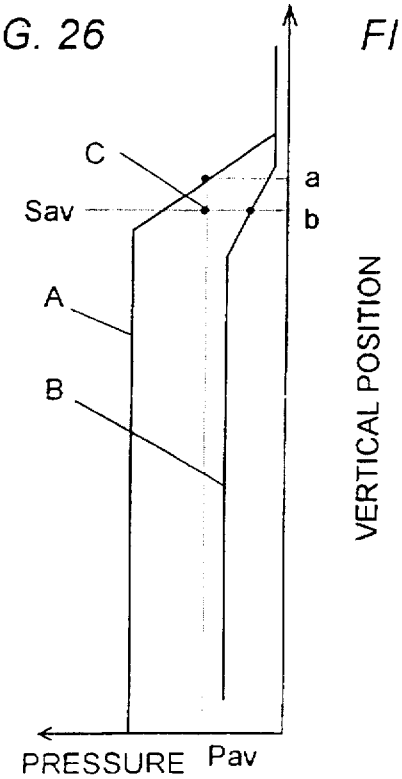

1) The shoulder position is judged as a position at which the corresponding pressure P exceeds a predetermined pressure Ps, as shown in FIG. 23;
2) The pressure distribution is analyzed, as shown in FIG. 24, to give a change rate δ of the pressure P, i.e., (Pb-Pa)/(a-b), (Pc-Pb)/(b-c), (Pd-Pc)/(d-c), for each of individual sections a-b, b-c, c-d, then the shoulder position is judged at a starting point of the particular section in which the change rate δ exceeds a predetermined value δs, in the illustrated instance, the point (c) is judged as the shoulder point;
3) The pressure distribution is analyzed to give a change rate δ as a derivative of the pressure P so that the shoulder position is judged at a position where the change rate δ exceeds a predetermined value δs;
4) The pressure distribution is analyzed, as shown in FIG. 25, to give a stroke L (L1 and L2 in the illustrated instance) of the applicator which is necessary to develop a predetermined pressure difference PO, then the stroke L (L1 and L2) are compared with a predetermined length Ls such that the shoulder position is judged as a starting point of the stroke which exceeds the predetermined length L. In the illustrated instance where L1<Ls<L2, the shoulder position is determined as point (b);
5) The shoulder position is identified as the position which satisfies at least two of the above methods 1) to 4);
6) When none of the above methods 1) to 4) succeeds to identify the shoulder position, the position analyzer relies upon a statistical data of pressure distributions for a number of persons, as shown in FIG. 26, and judges the shoulder position as a point (a) on the pressure distribution A at which the pressure P exceeds a particular pressure Pav which corresponds to a statistical center or average Sav of the shoulder position. When the pressure distribution B is only available in which the pressure on the distribution B do not exceed the particular pressure Pav, the shoulder position is judged as a point (b) corresponding to the statistical center Sav.

Figure 22:
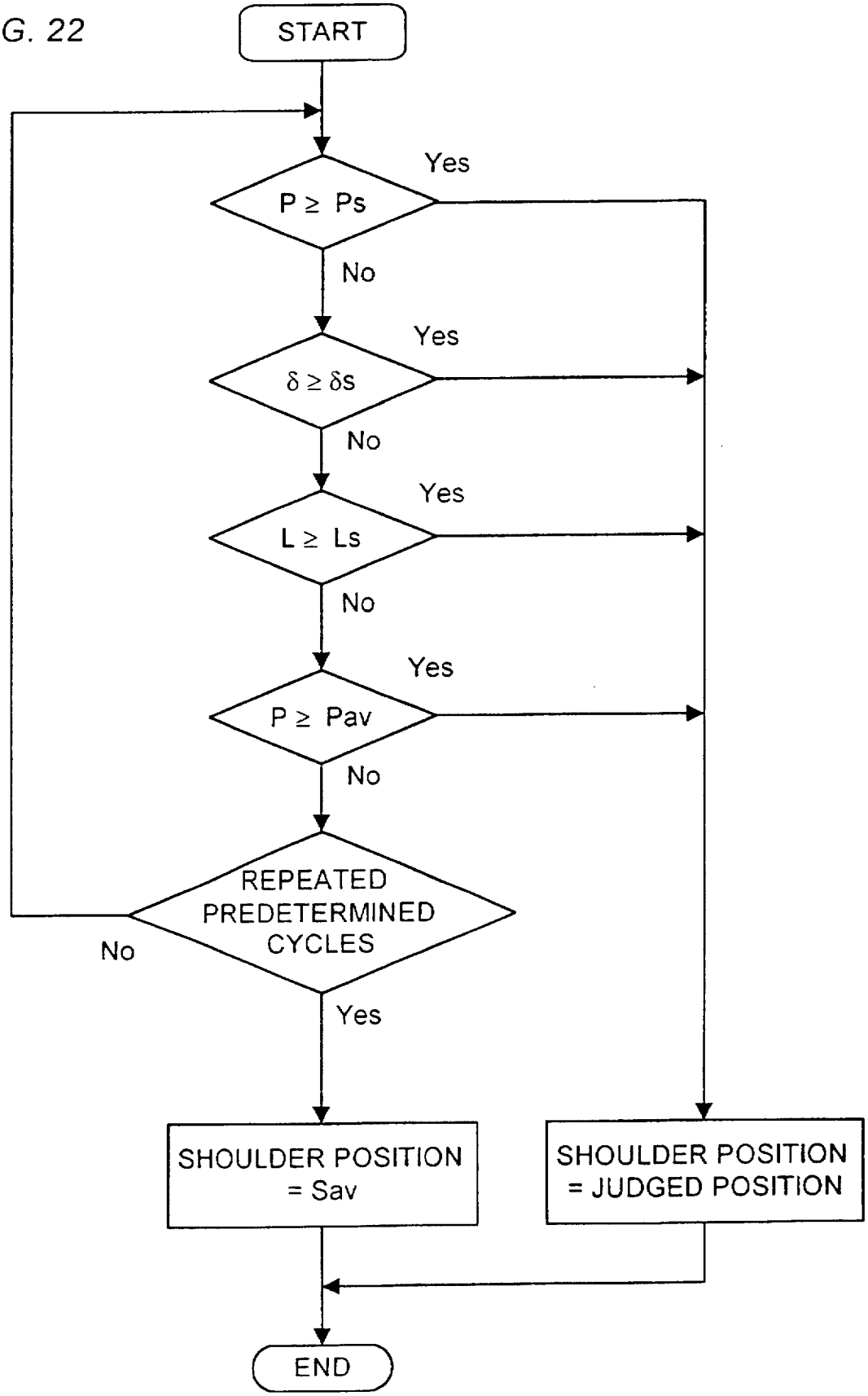
FIG. 22 is a flow chart for determining the pressure distribution.

The shoulder position is determined preferably in combination of the above methods, as illustrated in the flow chart of FIG. 22. That is, the above methods 1) to 4) are sequentially performed in several cycles until one of the method succeeds to identify the shoulder position. If none of the above methods succeed even after several cycles, the above method 6) is relied upon to give the shoulder position in consideration of the statistical data. It should be noted at this point that the pressure distribution is sampled preferably by moving the applicators 86 downwards along the up-and-down direction of the supporting frame 10. With this downward movement of the applicators, the monitored pressure increases from zero in a relatively sharp gradient which facilitates to identify the shoulder position in the above methods.

Figure 27:
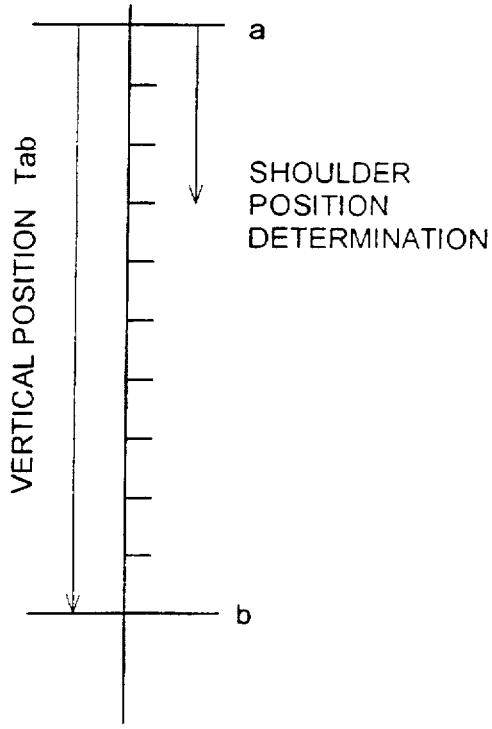
FIG. 27 illustrates another scheme of determining a shoulder position.

When the position analyzer 147 is unable to locate the applicator on a continuous basis but is rather allowed to locate the applicator stepwise by a predetermined step due to structural limitations such as by a limited number of the position sensors utilized, the shoulder position determined by the calibrator is not realized as an actual position of the applicator. For example, as shown in FIG. 27, when the shoulder position is determined at a position between the effective positions (a) and (b) at which the applicator can be located, the actual shoulder position should be identified for controlling the movement of the applicator. To this end, the calibrator relies upon a fuzzy theory to determine the actually controllable shoulder position in the following manner. Based upon a time measured for moving the applicator from the effective position (a) to position (b), the controller circuit calculates a sub-time for moving the applicator from either of the effective positions (a) or (b) to the shoulder position judged by the calibrator. Then, it is compared which sub-time is shorter or which of the effective positions (a) and (b) is closer to the shoulder position so that the actual shoulder position is finally determined as one of the adjacent effective position closer to the shoulder position firstly judged than the other. In the illustrated instance, the position (a) is finally determined as the actual shoulder position.

Figure 28B:
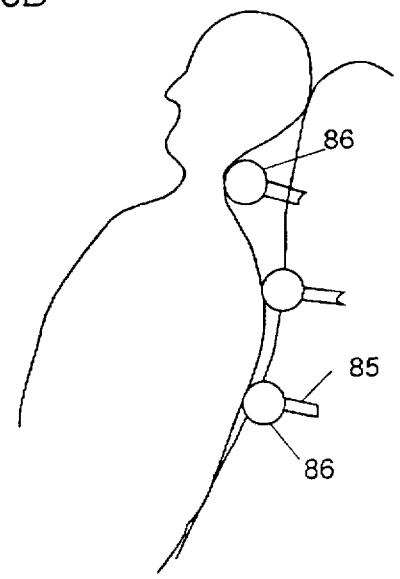
FIGS. 28A and 28B illustrate a projection distribution for the projecting amount of the applicator when moving the applicator along the length of the user's back in such a manner as to keep the monitored pressure at a constant level.
Figure 28A:
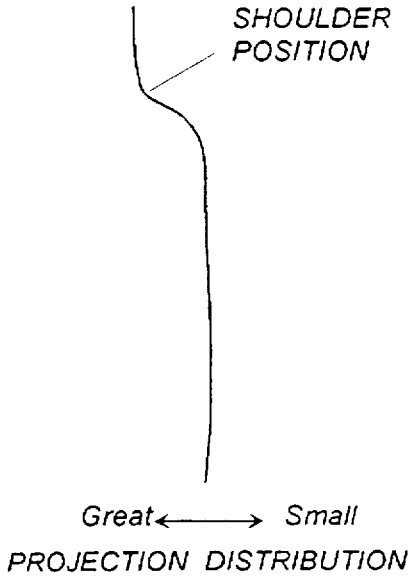

Although the contour and therefore the shoulder position is explained in the above to be determined based upon the pressure distribution, it is equally possible to determine the same based upon a projection distribution of the varying projection amount of the applicators plotted while moving the applicators in such a manner to keep the counter pressure at the fixed level, as shown in FIGS. 28A and 28B.

Determination of the side contour of the user's body

Figure 30:
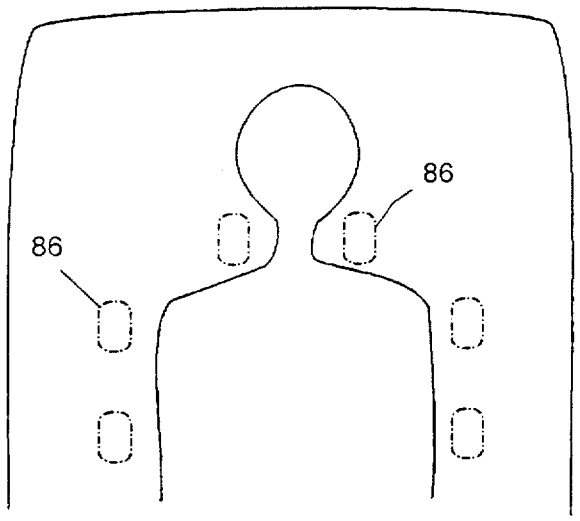
FIG. 30 is a schematic view illustrating a manner of analyzing a side contour of the user's body.
Figure 29:
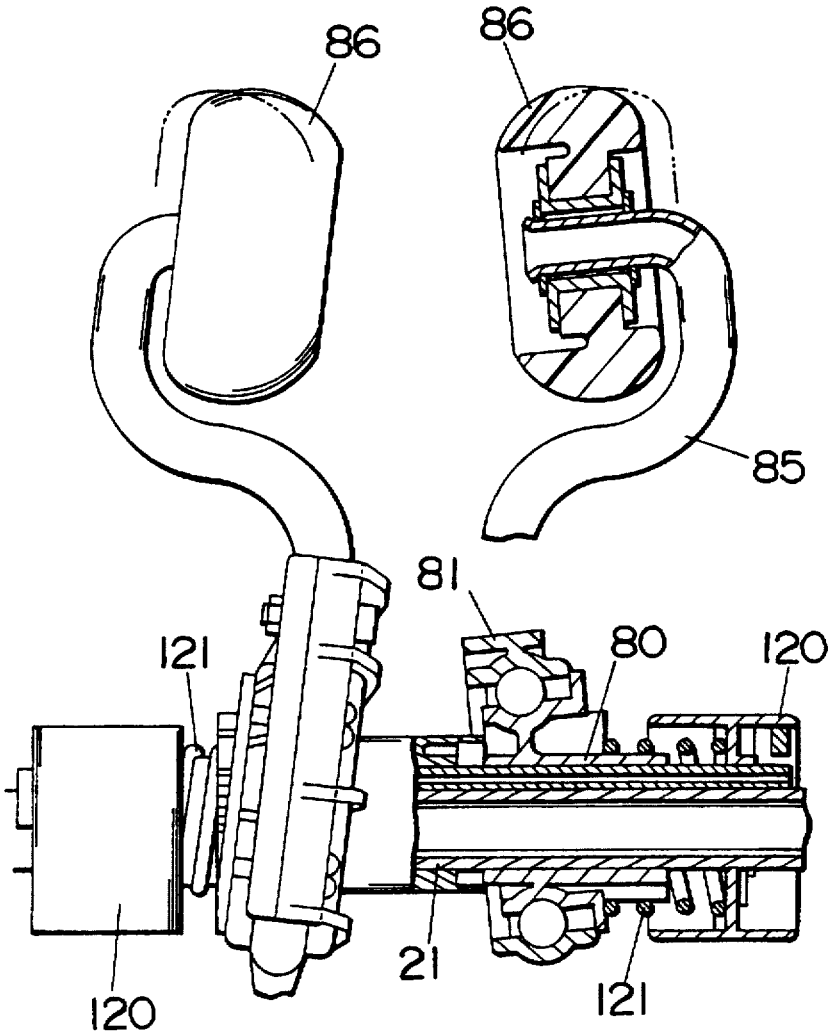
FIG. 29 is a partial view of the massage unit.

Further, the side contour of the user' body is also determined by the use of a pressure sensor 120 which monitors a sideward pressure applied back to the applicators 86 as a counter-action of pressing the applicators against the sides of the user. As shown in FIG. 29, the sensor 120 is provided on the main shaft 21 of the massage unit adjacent to each of the inner wheel 80 carrying the applicator and shiftable along the main shaft 21. The sensor comprises a spring 121 which is wound around the main shaft 21 in abutment with the inner wheel 80 so that it is compressed in an amount proportion to the axial shifting of the inner wheel 80, i.e., the sideward force applied back to the applicator 86. The sensor 120 detects the amount of compression as the sideward pressure and provides a corresponding output to the calibrator 146 in the control circuit 142. The calibrator 146 instructs to move the applicators 86 to move along the slides of the user's body with varying horizontal positions in a manner as shown in FIG. 30, while keeping the side pressures constant, thereby obtaining a distribution with regard to positional data of the applicators, indicating the side contour of the user's body. Thus obtained data is combined with the data of the lengthwise contour to give an accurate figure of the user for effecting more adequate control of the massage by the control circuit 142. In particular, based upon a neck width of the user obtained from the data, the control circuit 142 can control to avoid the applicators 86 from being pressed against the neck at an excessive force.

Control of the massage strength by motor current

Figure 31A:
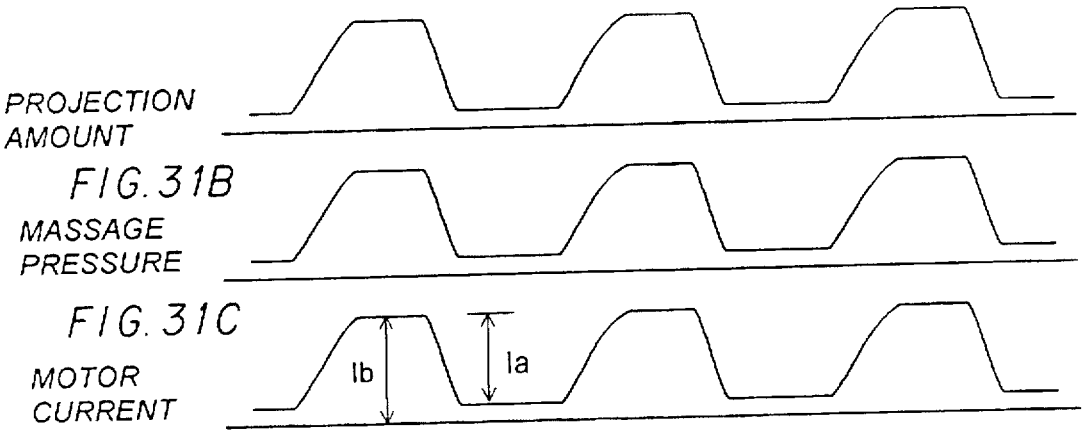
FIG. 31 illustrate relations among the projecting amount of the applicator, massage strength, and a motor current, respectively.

The counter-pressure applied back to the applicators 86 is also measured in terms of a motor current flowing through the main motor driving the main shaft 21 in consideration of that, as shown in FIG. 31, the motor current Ib varies cyclically depending upon the varying projection amount of the applicator and the massage strength exerted thereby. Thus, the motor current Ib can be an effective parameter of determining the contour of the user's body, while a relative current strength Ia represents the massage strength. By utilizing the motor current for determining the contour of the user's body and for monitoring the massage strength or pressure, the massage apparatus can eliminate the pressure sensors as described in the above.

Finger-press massage

Figure 32A:
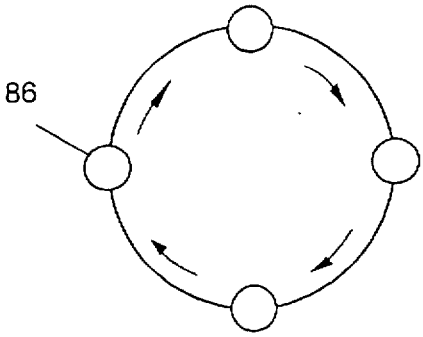
FIGS. 32A and 32B illustrate a one-way revolution of the applicator and a motor speed varying with the changing angular positions of the applicator when applying the massaging action to the user's body.
Figure 32B:
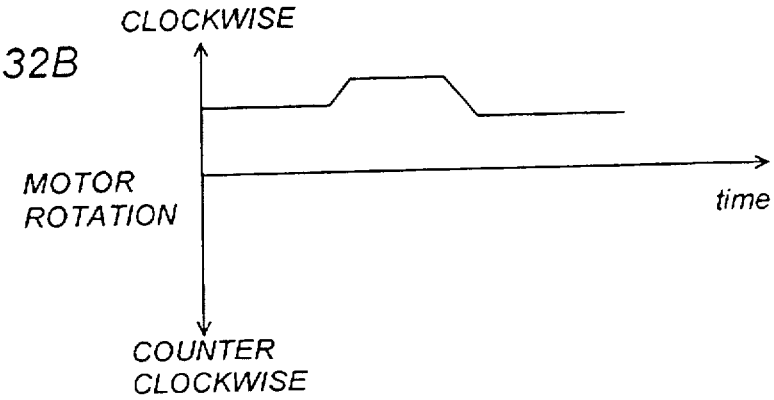

Normally, the applicator 86 traces a circular pattern, as shown in FIG. 32A and 32B, to give the massage action as the main shaft 21 rotates in one direction with varying speed by the main motor. It is, however, possible that the applicator 86 can simulate a finger-press massage by periodically reversing the rotating direction of the main shaft 21, as shown in FIGS. 33A to 33C, such that the applicator 86 can reciprocates along the circular path for a limited angular range about a position at which it is strongly pressed against the user's back. For more effective finger-press massage, a control is made to momentarily stop the main motor or the main shaft 21 prior to reversing the rotating direction, as shown in FIGS. 34A and 34B. A maximum finger-press strength can be set by adjusting the projection amount of the applicator.

Figure 35:
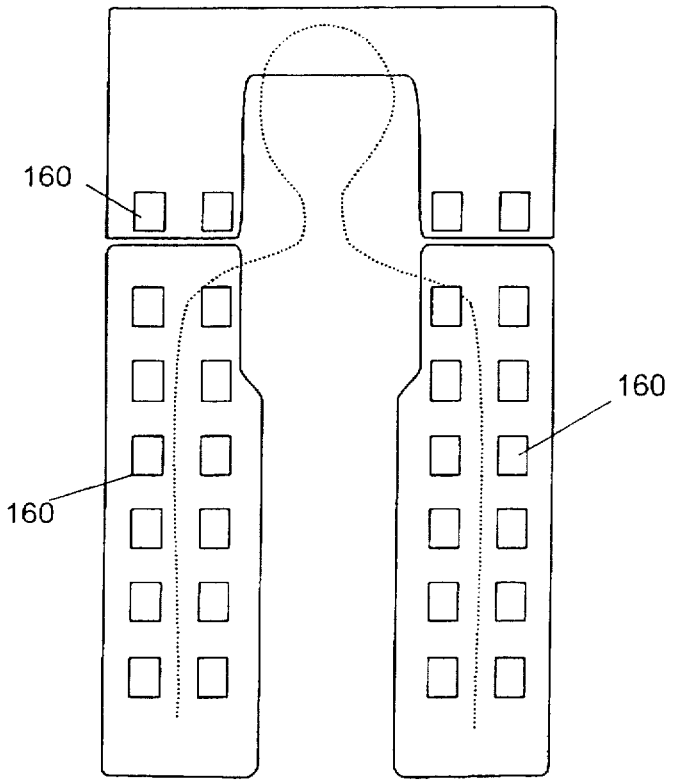
FIG. 35 is a diagram illustrating a scheme of analyzing the side contour of the user's body with the use of plural capacitor sensors.
Figure 36A:
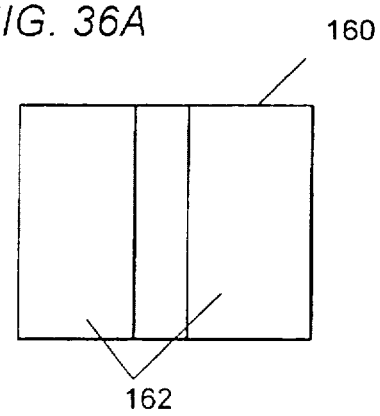
FIGS. 36A and 36B are top and side views of the capacitor sensor.
Figure 37:
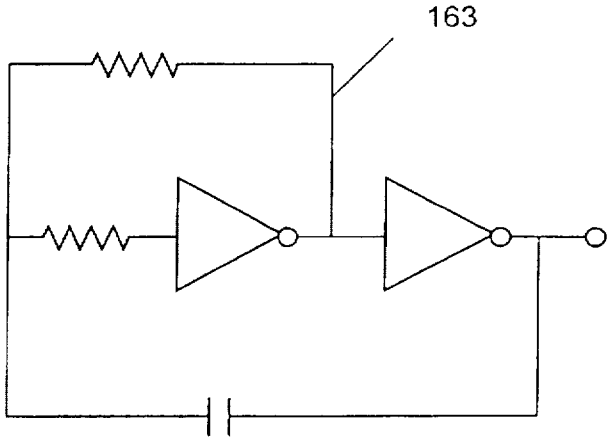
FIG. 37 is a circuit for analyzing the side contour.
Figure 36B:
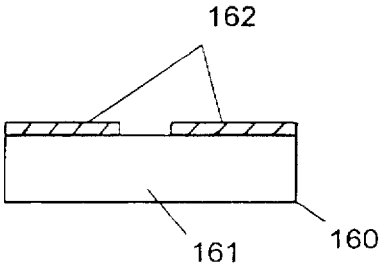

The contour of the user's body can be also measured with the use of a plurality of capacitor sensors 160 which are embedded in the back of the chair, as shown in FIG. 35, to detect a change in electrostatic capacity due to the nearby presence of the user. As shown in FIGS. 36A and 36B, the capacitor sensor 160 comprises a substrate 161 carrying a pair of capacitors 162 in a spaced relation, and is connected to an oscillator 163 for detecting a resulting frequency change as indicative of the change in the electrostatic capacitance for determination of the contour of the user.

What is claimed is:

1. A massaging apparatus having self-adjust, constant strength and non-adjust strength modes, said massaging unit in said self-adjust mode comprising:

a frame means for supporting a reclining chair on which a user rests, said reclining chair including a padded seat portion and an approximately upright back portion, said upright back portion including a pair of racks and a pair of rails;

a massage unit slidably mounted on said back portion of said reclining chair, said massage unit having a pair of applicators which project forwardly from said massage unit through an open area in said back portion in order to be pressed against a user's body and having a means for moving said massage unit up and down said back portion of said reclining chair on said racks and rails;

a drive means for moving said pair of applicators of said massage unit to apply a massaging force to the user's body;

a pressure sensor means for monitoring a pressure applied back to said pair of applicators from the user's body as a counter-action of applying said massaging force to the user's body and for providing an output indicative of said monitored pressure;

a strength-adjustor means for varying at least one parameter from a group consisting of two parameters as follow: a distance said applicator projects forwardly from said massaging unit; and an operational speed of moving said pair of applicators in order to adjust an initial massage strength applied to the user's body to an optimum massage strength for the user in accordance with said monitored pressure; and a control circuit comprising:

a manual controller means for manually controlling said initial massage strength selected by the user;

an auto-controller means connected to said pressure sensor for receiving said output of said pressure sensor and for actuating said strength-adjustor means for increasing or decreasing said initial massage strength to said optimum massage strength for the user in accordance with said monitored pressure, said auto-controller including a nullifier circuit means and a delay circuit means.

2. The massaging apparatus as set forth in claim 1, wherein said nullifier circuit means is for invalidating an instantaneous variation in said monitored pressure within a predetermined short period of time such that said auto-controller will not respond to actuate said strength-adjustor means to adjust said initial massage strength to said optimum massage strength for the user.

3. The massaging apparatus as set forth in claim 2, wherein said namual controller means is connected to said strength-adjustor means to manually adjust said initial massage strength, said auto-controller means including delay circuit means for enabling said auto-controller means to actuate said strength-adjustor means for adjusting said initial massage strength to said optimum massage strength only after a predetermined delay from a time of manually adjusting said initial massage strength by said manual-controller means.

4. The massaging apparatus as set forth in claim 3, wherein said auto-controller means includes means for increasing said pressure from said monitored pressure such that said auto-controller means operates to adjust said initial massage strength based upon said monitored pressure to which said increased pressure has been added.

5. The massaging apparatus as set forth in claim 4, wherein said auto-controller means includes stepping means for actuating said strength-adjustor means to increase and decrease said initial massage strength in a stepwise manner.

6. The massaging apparatus as set forth in claim 5, wherein said auto-controller means includes a means for actuating said strength-adjustor means to increase and decrease said initial massage strength promptly by one step to a destined level corresponding to said monitored pressure when said monitored pressure is far from said optimum massage strength by more than a predetermined amount of pressure.

7. A massaging apparatus having self-adjust, constant strength and non-adjust strength modes, said massaging unit in said constant strength mode comprising:

a frame means for supporting a reclining chair on which a user rests, said reclining chair including a padded seat portion and an approximately upright back portion, said upright back portion including a pair of racks and a pair of rails;

a massage unit slidably mounted on said back portion of said reclining chair, said massage unit having a pair of applicators which project forwardly from said massage unit through an open area in said back portion in order to be pressed against a user's body and having a means for moving said massage unit up and down said back portion of said reclining chair on said racks and rails;

a drive means for moving said pair of applicators of said massage unit to apply a massaging force to the user's body;

a pressure sensor means for monitoring a pressure applied back to said pair of applicators from the user's body as a counter-action of applying said massaging force to the user's body and for providing an output indicative of said monitored pressure;

a strength-adjustor means for varying at least one parameter from a group consisting of two parameters as follow: a distance said applicator projects forwardly from said massaging unit; and an operational speed of moving said pair of applicators in order to adjust an initial massage strength applied to the user's body to an optimum massage strength for the user in accordance with said monitored pressure; and a control circuit comprising:

a manual controller means for manually controlling said initial massage strength selected by the user;

an auto-controller means connected to said pressure sensor for receiving said output from said pressure sensor and for actuating said strength-adjustor means in order to increase or decrease said initial massaging strength to said optimum massage strength for the user in accordance with said monitored pressure, said auto-controller including a nullifier circuit means and a delay circuit means; and a pressure controller means for maintaining said initial massage strength selected by the user even when said monitored pressure deviates from a current massage strength continuously over a predetermined period of time by increasing or decreasing said distance said pair of applicators project forwardly of said massaging unit in order to adjust said current massage strength in line with said initially selected massage strength; and a selector means for selecting one of a group of two control circuit components including said auto-controller means and said pressure controller means.

8. The massaging apparatus as set forth in claim 7, further including an audio means for producing a sound indicating a switch from control by said auto-controller means to control by said pressure controller means and vice-versa.

9. A massaging apparatus capable of analyzing a user's back contour and shoulder position, said massaging apparatus comprising:

a frame means for supporting a reclining chair on which a user rests, said reclining chair including a padded seat portion and an approximately upright back portion, said upright back portion including a pair of racks and a pair of rails;

a massage unit slidably mounted on said back portion of said reclining chair, said massage unit having a pair of applicators which project forwardly from said massage unit through an open area in said back portion in order to be pressed against a user's body and having a means for moving said massage unit up and down said back portion of said reclining chair on said racks and rails;

a drive means for moving said pair of applicators of said massage unit to apply a massaging force to the user's body;

a strength-adjustor means for varying at least one of a distance said applicator projects forwardly from said back of said approximately upright back portion of said support means and an operational speed of moving said applicator in order to adjust a massage strength applied to the user's body;

a pressure sensor means for monitoring a pressure applied back to said applicators from the user's body as a counter-action of applying said massaging force to the user's body and for providing an output indicative of said monitored pressure; and a control circuit means comprising:

a calibrator means for operating in cooperation with said drive means and said strength-adjustor means to move said massage unit with said projecting pair of applicators up-and-down so that said pair of applicators are in pressed contact against different portions of the user's body while keeping said applicator projected by a constant distance in order to obtain a pressure distribution up-and-down said different portions of the user's body; and a means for controlling actuation of said strength adjustor means to vary said distance said pair of applicators project forwardly of said massage unit, based upon said pressure distribution, while moving said massage unit up-and-down said back portion of said reclining chair with said pair of applicators in contact with different portions of the user's body in order to give an optimum massage strength to different portions of the user's body.

10. The massaging apparatus as set forth in claim 9, wherein said calibrator means includes means for obtaining said pressure distribution by moving said pair of applicators downwardly along the user's body.

11. The massaging apparatus as set forth in claim 9, wherein said means for controlling actuation of said strength-adjustor means includes a position analyzer means to determine a shoulder position of the user's body based upon said pressure distribution.

12. The massaging apparatus as set forth in claim 11, wherein said position analyzer means includes means which determines said shoulder position at a position where said monitored pressure corresponds to a predetermined pressure.

13. The massaging apparatus as set forth in claim 11, wherein said position analyzer means includes means for determining said shoulder position at a position where a change rate of said monitored pressure corresponds to a predetermined rate.

14. The massaging apparatus as set forth in claim 11, wherein said position analyzer means includes means for determining said shoulder position at a starting position of said pair of applicators moving up-and-down in contact with the user's body, said starting position being defined such that said monitored pressure is changed by a predetermined amount of pressure when said pair of applicators move a predetermined distance from said starting position along up-and-down in contact with the user's body.

15. The massaging apparatus as set forth in claim 11, wherein said position analyzer means includes:

a first means for determining said shoulder position at a position where said monitored pressure corresponds to a predetermined pressure;

a second means for determining said shoulder position at a position where a change rate of said monitored pressure corresponds to a predetermined rate;

a third means for determining said shoulder position at a starting position of said applicator moving up-and-down in contact with the user's body, said starting position being defined such that said monitored pressure is changed by a predetermined amount of pressure when said pair of applicators move a predetermined distance from said starting position up-and-down with said massage unit and in contact with different portions of the user's body; and said position analyzer means including means for validating said shoulder position which is determined by at least one of said first, second and third means.

16. The massaging apparatus as set forth in claim 11, wherein said position analyzer means includes means for operating to repeat moving said pair of applicators on said massage unit in plural cycles up-and-down the user's body until said shoulder position is determined.

17. The massaging apparatus as set forth in claim 11, wherein said position analyzer includes means for giving an approximate value for said shoulder position when said position analyzer means fails to clearly determine said shoulder position and gives a shoulder position in consideration of said approximate value.

18. The massaging apparatus as set forth in claim 11, wherein said position analyzer means includes means for giving a predetermined fixed position as said shoulder position when said position analyzer means fails to determine said shoulder position.

19. The massaging apparatus as set forth in claim 18, wherein said position analyzer means includes means for setting said predetermined fixed position as a statistical center of a number of shoulder positions collected from a number of subjects.

* * * * *